US012709952B2

(12) United States Patent
Converset et al.

(10) Patent No.: US 12,709,952 B2
(45) **Date of Patent: *Aug. 18, 2026**

(54) DRILLING FLUID FRAMEWORK

(71) Applicant: Schlumberger Technology Corporation, Sugar Land, TX (US)

(72) Inventors: Julien Converset, Sugar Land, TX (US); Aditya Garga, Saint Nom la Breteche (FR); Can Evren Yarman, Clamart (FR); Dieter Knoll, Montpellier (FR); Damien Lecha, Montpellier (FR); Antoine Vaslin, Montpellier (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/287,239

(22) Filed: Jul. 31, 2025

(65) Prior Publication Data

US 2025/0361780 A1 Nov. 27, 2025

Related U.S. Application Data

(63) Continuation of application No. 18/240,872, filed on Aug. 31, 2023, now Pat. No. 12,392,204.

(60) Provisional application No. 63/374,244, filed on Sep. 1, 2022.

(51) Int. Cl.
*E21B 21/08* (2006.01)

(52) U.S. Cl.
CPC ..... *E21B 21/08* (2013.01)

(58) Field of Classification Search
CPC ..... E21B 21/06; E21B 21/08; E21B 47/047
See application file for complete search history.

(56) References Cited

U.S. PATENT DOCUMENTS 3,608,653 A * 9/1971 Rehm ..... E21B 21/08 175/218
4,290,305 A * 9/1981 Gibson ..... G01F 1/007 73/152.49
4,840,061 A * 6/1989 Peltier ..... E21B 21/08 73/152.21

(Continued)

FOREIGN PATENT DOCUMENTS

CN 117072143 A * 11/2023 ..... E21B 47/00
WO 2019013648 A1 1/2019
WO WO-2021087509 A1 * 5/2021 ..... E21B 21/08

*Primary Examiner* — Jennifer H Gay
(74) *Attorney, Agent, or Firm* — Kyle R. Miiller

(57) ABSTRACT

A method may include receiving real-time data relating to drilling fluid for drilling operations that utilize a drilling fluid system that includes tanks and pumps, where the drilling operations include operations that pump the drilling fluid to a drill bit on a drillstring that rotates to extend a borehole in a formation, and where the drilling fluid flows to an annulus between the drillstring and the formation to apply pressure to the formation; detecting a tank state from a group of tank states based at least in part on the real-time data, where the group of tank states includes tank states defined with respect to one or more operations of the pumps; and detecting a change in tank volume, based at least in part on the tank state, as an indicator of an undesirable interaction between the drilling fluid and the formation.

20 Claims, 17 Drawing Sheets

(56) References Cited

U.S. PATENT DOCUMENTS 5,080,182 A * 1/1992 Thompson ..... E21B 49/005 73/152.43
7,562,723 B2 * 7/2009 Reitsma ..... E21B 21/106 175/218
7,650,950 B2 * 1/2010 Leuchtenberg ..... E21B 44/00 175/48
9,022,140 B2 * 5/2015 Marx ..... G06N 7/01 175/50
10,060,208 B2 * 8/2018 Gumus ..... E21B 44/00
10,208,548 B2 * 2/2019 Francois ..... G01F 9/001
10,859,082 B2 * 12/2020 Parmeshwar ..... G01F 25/0092
11,384,612 B2 * 7/2022 Hauge ..... E21B 21/08
11,643,891 B2 * 5/2023 Brana ..... E21B 44/00 175/25
11,965,405 B2 * 4/2024 Botnan ..... E21B 47/117
12,024,998 B2 * 7/2024 Converset ..... E21B 21/08
12,152,481 B2 * 11/2024 Mehta ..... G06Q 10/0639
12,392,204 B2 * 8/2025 Converset ..... E21B 21/08
2007/0151762 A1 * 7/2007 Reitsma ..... E21B 21/08 175/45
2008/0041149 A1 * 2/2008 Leuchtenberg ..... E21B 21/08 73/152.21
2014/0116776 A1 * 5/2014 Marx ..... E21B 12/02 706/11
2016/0245027 A1 * 8/2016 Gumus ..... E21B 44/00
2017/0175467 A1 * 6/2017 Francois ..... E21B 21/08
2019/0055937 A1 * 2/2019 Parmeshwar ..... F04B 9/045
2020/0386066 A1 * 12/2020 Brana ..... E21B 21/106
2021/0010365 A1 * 1/2021 Botnan ..... E21B 19/165
2022/0154570 A1 * 5/2022 Mehta ..... E21B 45/00
2023/0243254 A1 * 8/2023 Converset ..... E21B 21/08 166/250.03
2024/0003246 A1 * 1/2024 Mu ..... E21B 44/00
2024/0076946 A1 * 3/2024 Converset ..... E21B 21/08
2024/0419867 A1 * 12/2024 Ruzhnikov ..... E21B 41/00
2024/0426203 A1 * 12/2024 Ameen ..... E21B 21/08
2025/0111448 A1 * 4/2025 Whyte ..... E21B 44/00
2025/0361780 A1 * 11/2025 Converset ..... E21B 21/08

* cited by examiner

400

Tank (e.g., pit) State Codes:

| # | Color | Name | Description | Pumping | Active Volume Change (Expected) |
|---|---|---|---|---|---|
| 0 | | Down | Flow Rate is Staging Down and Activity Pits are Expected to Change | Down | Up |
| 1 | | Stable | Flow Rate is Stable and Active Pits are Expected Stable | Yes | Stable |
| 2 | | Transient | Flow Rate is Stable and Active Pits are Expected to Change | Yes | Down |
| 3 | | Up | Flow Rate is Staging up and Active Pits are Expected to Change | Up | Down |
| 4 | | Zero | Flow Rate is Zero and Active Pits Volume is Expected Stable | No | Stable |
| 5 | | Unknown | Unknown | Unknown | Unknown |
| 6 | | Unstable | Flow Rate Zero and Active Pits Volume is Expected to Change | No | Up |
| 7 | | Downlink | Downlink | Unknown | Unknown |

Fig. 4

DRILLING FLUID FRAMEWORK

RELATED APPLICATION

This application is a continuation and claims priority to and the benefit of a U.S. patent application having Ser. No. 18/240,872, filed 31 Aug. 2023, issued as U.S. Pat. No. 12,392,204, which claims priority to and the benefit of a US Provisional Application having Ser. No. 63/374,244, filed 1 Sep. 2022. The above applications are incorporated by reference herein in each of their entirety.

BACKGROUND

Unless otherwise indicated, this section does not describe prior art to the claims and is not admitted prior art.

Modern drilling techniques, whether for water, hydrocarbons, geothermal, or other, generally involve the use of drilling fluids (also referred to as drilling mud or simply mud) as part of the drilling process. Drilling fluids are typically pumped to the bottom of the hole and pick up cuttings made by the bit, then lift them to the surface for disposal. Drilling fluids frequently serve a wide range of additional purposes. Solid particles in the drilling fluid may be used to plaster the sides of the hole to keep them from caving in. The mixture of drilling fluids may vary in its composition (oil, water, gases, etc.) depending on the objectives for the well or for a particular section being drilled.

A drilling rig typically includes circulating equipment for circulating and managing the drilling fluids. The circulating system typically includes mud tanks where drilling fluids are stored, as well as mud pumps for pumping the drilling fluids. The mud tanks are also frequently referred to as mud pits. The mud tanks may include active tanks and reserve tanks storing drilling fluid mixtures to be used at a different time.

The volumes of drilling fluids may be indicators of problems or issues during a drilling process. For example, unexpected increases in the fluid may indicate that fluids are leaving the formation and entering the borehole, meaning a kick may be coming. Unexpected decreases in the fluid may indicate that the fluids are entering the formation and fluid losses are resulting. Given the complexity of the interaction between fluid volumes, a plan, and a drilling process, understanding how to interpret what the fluid levels mean for a drilling process may be challenging. This may make creating intelligent and meaningful alarms and notifications based on drilling fluids a challenge.

SUMMARY

A method may include receiving real-time data relating to drilling fluid for drilling operations that utilize a drilling fluid system that includes tanks and pumps, where the drilling operations include operations that pump the drilling fluid to a drill bit on a drillstring that rotates to extend a borchole in a formation, and where the drilling fluid flows to an annulus between the drillstring and the formation to apply pressure to the formation; detecting a tank state from a group of tank states based at least in part on the real-time data, where the group of tank states include tank states defined with respect to one or more operations of the pumps; and detecting a change in tank volume, based at least in part on the tank state, as an indicator of an undesirable interaction between the drilling fluid and the formation. A system may include one or more processors; memory accessible to at least one of the one or more processors; processor-executable instructions stored in the memory and executable to instruct the system to: receive real-time data relating to drilling fluid for drilling operations that utilize a drilling fluid system that includes tanks and pumps, where the drilling operations include operations that pump the drilling fluid to a drill bit on a drillstring that rotates to extend a borehole in a formation, and where the drilling fluid flows to an annulus between the drillstring and the formation to apply pressure to the formation; detect a tank state from a group of tank states based at least in part on the real-time data, where the group of tank states includes tank states defined with respect to one or more operations of the pumps; and detect a change in tank volume, based at least in part on the tank state, as an indicator of an undesirable interaction between the drilling fluid and the formation. One or more non-transitory computer-readable storage media may include processor-executable instructions to instruct a computing system to: receive real-time data relating to drilling fluid for drilling operations that utilize a drilling fluid system that includes tanks and pumps, where the drilling operations include operations that pump the drilling fluid to a drill bit on a drillstring that rotates to extend a borehole in a formation, and where the drilling fluid flows to an annulus between the drillstring and the formation to apply pressure to the formation; detect a tank state from a group of tank states based at least in part on the real-time data, where the group of tank states includes tank states defined with respect to one or more operations of the pumps; and detect a change in tank volume, based at least in part on the tank state, as an indicator of an undesirable interaction between the drilling fluid and the formation. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The following detailed description refers to the accompanying drawings. Wherever convenient, features and advantages of the described implementations may be more readily understood by reference to the following description taken in conjunction with the accompanying drawings.

FIG. 4 shows an example of a table;

DETAILED DESCRIPTION

Introduction

Figure 1:
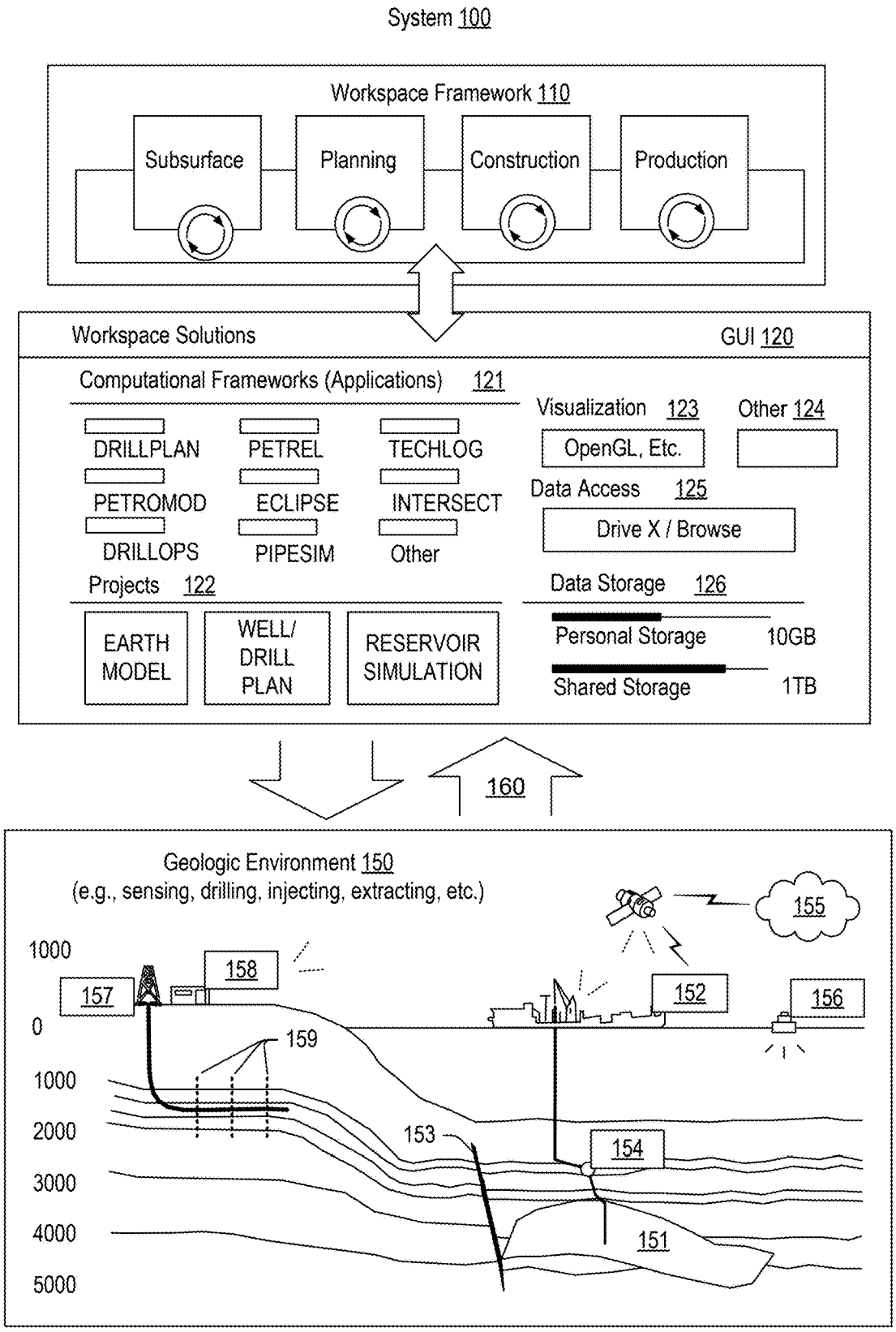
FIG. 1 shows an example of a system.

The following detailed description refers to the accompanying drawings. Wherever convenient, the same reference numbers are used in the drawings and the following description to refer to the same or similar parts. While several embodiments and features of the present disclosure are described herein, modifications, adaptations, and other implementations are possible, without departing from the spirit and scope of the present disclosure.

Although the terms "first", "second", etc. may be used herein to describe various elements, these terms are used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Embodiments

This description is not to be taken in a limiting sense, but rather is made merely for the purpose of describing the general principles of the implementations. The scope of the described implementations should be ascertained with reference to the issued claims.

FIG. 1 shows an example of a system 100 that includes a workspace framework 110 that may provide for instantiation of, rendering of, interactions with, etc., a graphical user interface (GUI) 120. In the example of FIG. 1, the GUI 120 may include graphical controls for computational frameworks (e.g., applications, etc.) 121, projects 122, visualization features 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. As an example, the geologic environment 150 may be outfitted with a variety of sensors, detectors, actuators, etc. For example, equipment 152 may include communication circuitry that may be configured to receive and to transmit information with respect to one or more networks 155. Such information may include information associated with downhole equipment 154, which may be equipment to acquire information, to assist with resource recovery, etc. Other equipment 156 may be located remote from a wellsite and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows some examples of computational frameworks, including the DRILLPLAN, DRILLOPS, PETREL, TECHLOG, PETROMOD, ECLIPSE, PIPESIM, and INTERSECT frameworks (SLB, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The DRILLOPS framework may execute a digital drilling plan and ensures plan adherence, while delivering goal-based automation. The DRILLOPS framework may generate activity plans automatically for individual operations, whether they are monitored and/or controlled on the rig or in town. Automation may utilize data analysis and learning systems to assist and optimize tasks, such as, for example, setting ROP to drilling a stand. A preset menu of automatable drilling tasks may be rendered, and, using data analysis and models, a plan may be executed in a manner to achieve a specified goal, where, for example, measurements may be utilized for calibration. The DRILLOPS framework provides flexibility to modify and replan activities dynamically, for example, based on a live appraisal of various factors (e.g., equipment, personnel, and supplies). Well construction activities (e.g., tripping, drilling, cementing, etc.) may be continually monitored and dynamically updated using feedback from operational activities. The DRILLOPS framework may provide for various levels of automation based on planning and/or re-planning (e.g., via the DRILLPLAN framework), feedback, etc.

The PETREL framework may be part of the DELFI environment for utilization in geosciences and geoengineering, for example, to analyze subsurface data from exploration to production of fluid from a reservoir. The DELFI cognitive exploration and production (E&P) environment (SLB, Houston, Texas), referred to herein as the DELFI environment or DELFI framework, is a secure, cognitive, cloud-based collaborative environment that integrates data and workflows with digital technologies, such as artificial intelligence and machine learning.

The PETREL framework provides components that allow for optimization of various exploration, development and production operations. The PETREL framework includes seismic to simulation software components that may output information for use in increasing reservoir performance, for example, by improving asset team productivity. Through use of such a framework, various professionals (e.g., geophysicists, geologists, and reservoir engineers) may develop collaborative workflows and integrate operations to streamline processes (e.g., with respect to one or more geologic environments, etc.). Such a framework may be considered an application (e.g., executable using one or more devices) and may be considered a data-driven application (e.g., where data is input for purposes of modeling, simulating, etc.).

The TECHLOG framework may handle and process field and laboratory data for a variety of geologic environments (e.g., deepwater exploration, shale, etc.). The TECHLOG framework may structure wellbore data for analyses, planning, etc.

The PETROMOD framework provides petroleum systems modeling capabilities that may combine one or more of seismic, well, and geological information to model the evolution of a sedimentary basin. The PETROMOD framework may predict if, and how, a reservoir has been charged with hydrocarbons, including the source and timing of hydrocarbon generation, migration routes, quantities, and hydrocarbon type in the subsurface or at surface conditions.

The ECLIPSE framework provides a reservoir simulator (e.g., as a computational framework) with numerical solutions for fast and accurate prediction of dynamic behavior for various types of reservoirs and development schemes.

The INTERSECT framework provides a high-resolution reservoir simulator for simulation of detailed geological features and quantification of uncertainties, for example, by creating accurate production scenarios and, with the integration of precise models of the surface facilities and field operations, the INTERSECT framework may produce reliable results, which may be continuously updated by real-time data exchanges (e.g., from one or more types of data acquisition equipment in the field that may acquire data during one or more types of field operations, etc.). The INTERSECT framework may provide completion configurations for complex wells where such configurations may be built in the field, may provide detailed enhanced-oil-recovery (EOR) formulations where such formulations may be implemented in the field, may analyze application of steam injection and other thermal EOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI environment, for example, for rapid simulation of multiple concurrent cases. For example, a workflow may utilize one or more of the DELFI environment on demand reservoir simulation features.

The aforementioned DELFI environment provides various features for workflows as to subsurface analysis, planning, construction and production, for example, as illustrated in the workspace framework 110. As shown in FIG. 1, outputs from the workspace framework 110 may be utilized for directing, controlling, etc., one or more processes in the geologic environment 150 and, feedback 160, may be received via one or more interfaces in one or more forms (e.g., acquired data as to operational conditions, equipment conditions, environment conditions, etc.).

As an example, a workflow may progress to a geology and geophysics ("G&G") service provider, which may generate a well trajectory, which may involve execution of one or more G&G frameworks (e.g., consider the PETREL framework, etc.).

In the example of FIG. 1, the visualization features 123 may be implemented via the workspace framework 110, for example, to perform tasks as associated with one or more of subsurface regions, planning operations, constructing wells and/or surface fluid networks, and producing from a reservoir.

As an example, visualization features may provide for visualization of various earth models, properties, etc., in one or more dimensions. As an example, visualization features may provide for rendering of information in multiple dimensions, which may optionally include multiple resolution rendering. In such an example, information being rendered may be associated with one or more frameworks and/or one or more data stores. As an example, visualization features may include one or more control features for control of equipment, which may include, for example, field equipment that may perform one or more field operations. As an example, a workflow may utilize one or more frameworks to generate information that may be utilized to control one or more types of field equipment (e.g., drilling equipment, wireline equipment, fracturing equipment, etc.).

As to a reservoir model that may be suitable for utilization by a simulator, consider acquisition of seismic data as acquired via reflection seismology, which finds use in geophysics, for example, to estimate properties of subsurface formations. As an example, reflection seismology may provide seismic data representing waves of elastic energy (e.g., as transmitted by P-waves and S-waves, in a frequency range of approximately 1 Hz to approximately 100 Hz). Seismic data may be processed and interpreted, for example, to understand better composition, fluid content, extent and geometry of subsurface rocks. Such interpretation results may be utilized to plan, simulate, perform, etc., one or more operations for production of fluid from a reservoir (e.g., reservoir rock, etc.).

As an example, a model may be a simulated version of a geologic environment. As an example, a simulator may include features for simulating physical phenomena in a geologic environment based at least in part on a model or models. A simulator, such as a reservoir simulator, may simulate fluid flow in a geologic environment based at least in part on a model that may be generated via a framework that receives seismic data. A simulator may be a computerized system (e.g., a computing system) that may execute instructions using one or more processors to solve a system of equations that describe physical phenomena subject to various constraints. In such an example, the system of equations may be spatially defined (e.g., numerically discretized) according to a spatial model that includes layers of rock, geobodies, etc., that have corresponding positions that may be based on interpretation of seismic and/or other data. A spatial model may be a cell-based model where cells are defined by a grid (e.g., a mesh). A cell in a cell-based model may represent a physical area or volume in a geologic environment where the cell may be assigned physical properties (e.g., permeability, fluid properties, etc.) that may be germane to one or more physical phenomena (e.g., fluid volume, fluid flow, pressure, etc.). A reservoir simulation model may be a spatial model that may be cell-based.

While several simulators are illustrated in the example of FIG. 1, one or more other simulators may be utilized, additionally or alternatively. For example, consider the VISAGE geomechanics simulator (SLB, Houston Texas) or the PIPESIM network simulator (SLB, Houston Texas), etc. The VISAGE simulator includes finite element numerical solvers that may provide simulation results such as, for example, results as to compaction and subsidence of a geologic environment, well and completion integrity in a geologic environment, cap-rock and fault-seal integrity in a geologic environment, fracture behavior in a geologic environment, thermal recovery in a geologic environment, CO2 disposal, etc. The PIPESIM simulator includes solvers that may provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (SLB, Houston Texas). As an example, a reservoir or reservoirs may be simulated with respect to one or more enhanced recovery techniques (e.g., consider a thermal process such as steam-assisted gravity drainage (SAGD), etc.). As an example, the PIPESIM simulator may be an optimizer that may optimize one or more operational scenarios at least in part via simulation of physical phenomena. The MANGROVE simulator (SLB, Houston, Texas) provides for optimization of stimulation design (e.g., stimulation treatment operations such as hydraulic fracturing) in a reservoir-centric environment. The MANGROVE framework may combine scientific and experimental work to predict geomechanical propagation of hydraulic fractures, reactivation of natural fractures, etc., along with production forecasts within 3D reservoir models (e.g., production from a drainage area of a reservoir where fluid moves via one or more types of fractures to a well and/or from a well).

As an example, a tool may be positioned to acquire information in a portion of a borehole. Analysis of such information may reveal vugs, dissolution planes (e.g., dissolution along bedding planes), stress-related features, dip events, etc. As an example, a tool may acquire information that may help to characterize a fractured reservoir, optionally where fractures may be natural and/or artificial (e.g., hydraulic fractures). Such information may assist with completions, stimulation treatment, etc. As an example, information acquired by a tool may be analyzed using a framework such as the aforementioned TECHLOG framework.

As an example, a workflow may utilize one or more types of data for one or more processes (e.g., stratigraphic modeling, basin modeling, completion designs, drilling, production, injection, etc.). As an example, one or more tools may provide data that may be used in a workflow or workflows that may implement one or more frameworks (e.g., PETREL, TECHLOG, PETROMOD, ECLIPSE, etc.).

In the example of FIG. 1, drilling may be performed in the geologic environment 150, for example, to access the reservoir 151, which may be accessed from land or offshore. In FIG. 1, the downhole equipment 154 may be, for example, part of a bottom hole assembly (BHA). The BHA may be used to drill a well. The downhole equipment 154 may communicate information to equipment at the surface. The downhole equipment 154 may receive instructions and information from the equipment at the surface. During a well construction process, a variety of operations (such as cementing, wireline evaluation, testing, etc.) may be conducted. In such embodiments, data collected by tools and sensors and used for reasons such as reservoir characterization may be collected and transmitted.

A well may include a substantially horizontal portion (e.g., lateral portion) that may intersect with one or more fractures. For example, a well in a shale formation may pass through natural fractures, artificial fractures (e.g., hydraulic fractures), or a combination thereof. Such a well may be constructed using directional drilling techniques as described herein. However, these same techniques may be used in connection with other types of directional wells (such as slant wells, S-shaped wells, deep inclined wells, and others) and are not limited to horizontal wells.

Figure 2:
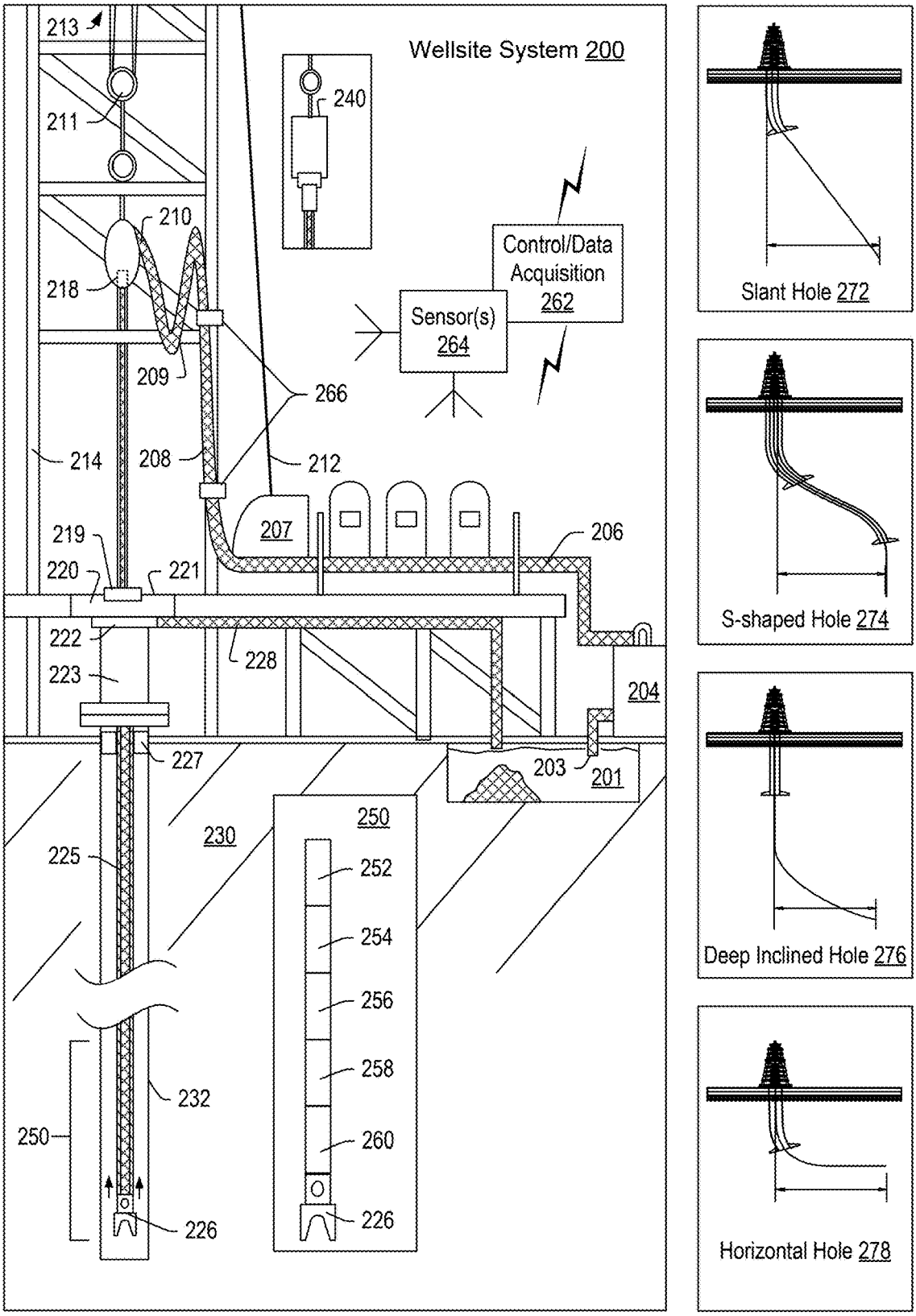
FIG. 2 shows an example of a system.

FIG. 2 shows an example of a wellsite system 200 (e.g., at a wellsite that may be onshore or offshore). As shown, the wellsite system 200 may include a mud tank 201 for holding mud and other material (e.g., where mud may be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212, a derrick 214, a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use one or more directional drilling techniques, equipment, etc.

As shown in the example of FIG. 2, the drillstring 225 is suspended within the borchole 232 and has a drillstring assembly 250 that includes the drill bit 226 at its lower end. As an example, the drillstring assembly 250 may be a bottom hole assembly (BHA).

The wellsite system 200 may provide for operation of the drillstring 225 and other operations. As shown, the wellsite system 200 includes the traveling block 211 and the derrick 214 positioned over the borchole 232. As mentioned, the wellsite system 200 may include the rotary table 220 where the drillstring 225 pass through an opening in the rotary table 220.

As shown in the example of FIG. 2, the wellsite system 200 may include the kelly 218 and associated components, etc., or a top drive 240 and associated components. As to a kelly example, the kelly 218 may be a square or hexagonal metal/alloy bar with a hole drilled therein that serves as a mud flow path. The kelly 218 may be used to transmit rotary motion from the rotary table 220 via the kelly drive bushing 219 to the drillstring 225, while allowing the drillstring 225 to be lowered or raised during rotation. The kelly 218 may pass through the kelly drive bushing 219, which may be driven by the rotary table 220. As an example, the rotary table 220 may include a master bushing that operatively couples to the kelly drive bushing 219 such that rotation of the rotary table 220 may turn the kelly drive bushing 219 and hence the kelly 218. The kelly drive bushing 219 may include an inside profile matching an outside profile (e.g., square, hexagonal, etc.) of the kelly 218; however, with slightly larger dimensions so that the kelly 218 may freely move up and down inside the kelly drive bushing 219.

As to a top drive example, the top drive 240 may provide functions performed by a kelly and a rotary table. The top drive 240 may turn the drillstring 225. As an example, the top drive 240 may include one or more motors (e.g., electric and/or hydraulic) connected with appropriate gearing to a short section of pipe called a quill, that in turn may be screwed into a saver sub or the drillstring 225 itself. The top drive 240 may be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 may hold mud, which may be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines 206, 208 and 209 to a port of the kelly 218 or, for example, to a port of the top drive 240. The mud may then flow via a passage (e.g., or passages) in the drillstring 225 and out of ports located on the drill bit 226 (see, e.g., a directional arrow). As the mud exits the drillstring 225 via ports in the drill bit 226, it may then circulate upwardly through an annular region between an outer surface(s) of the drillstring 225 and surrounding wall(s) (e.g., open borchole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borchole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud may be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes various modules 254, 256, and 258, which may be or include a logging-while-drilling (LWD) module (e.g., a LWD tool), a measurement-while-drilling (MWD) module (e.g., an MWD tool), and/or one or more other modules. As an example, a module 260 may be or include a rotary-steerable system (RSS) (e.g., an RSS or an RSS tool) and/or a motor (e.g., a mud motor, etc.). In various examples, a drillstring may include an RSS tool, a mud motor or an RSS tool and a mud motor. As shown, the assembly 250 includes the drill bit 226. Such components or modules may be referred to as tools where a drillstring may include a plurality of tools.

As to an RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling may commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor may present some challenges depending on factors such as rate of penetration (ROP), transferring weight to a bit (e.g., weight on bit, WOB) due to friction, etc. A mud motor may be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a mud motor (e.g., a PDM) may be operated in different modes, which may include a rotating mode and a sliding mode. A sliding mode involves drilling with a mud motor rotating the bit downhole without rotating the drillstring from the surface. Such an operation may be conducted when a BHA has been fitted with a bent sub or a bent housing mud motor, or both, for directional drilling. Sliding may be used in building and controlling or adjusting hole angle. In directional drilling, pointing of a bit may be accomplished through a bent sub, which may have a relatively small angle offset from the axis of a drillstring, and a measurement device to determine the direction of offset. Without turning the drillstring, the bit may be rotated with mud flow through the mud motor to drill in the direction it is pointed. With steerable motors, when a desired wellbore direction is attained, the entire drillstring may be rotated to drill straight rather than at an angle. By controlling the amount of hole drilled in the sliding mode versus the rotating mode, a wellbore trajectory may be controlled rather precisely.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM may be determined or estimated as a sum of the SRPM and the mud motor RPM, assuming the SRPM and the mud motor RPM are in the same direction.

As an example, a PDM mud motor may operate in a so-called sliding mode, when the drillstring is not rotated from the surface (e.g., as in a rotating mode). In such an example, a bit RPM may be determined or estimated based on the RPM of the mud motor. As an example, a drillstring that includes a mud motor may be oscillated using a surface mechanism such as, for example, a top drive. In such an example, the top drive may oscillate the drillstring clockwise and counterclockwise while drilling fluid drives rotation of the mud motor. In such an example, one or more techniques may be employed to control direction of drilling (e.g., bit orientation), extent of oscillations, etc. As oscillations involve both clockwise and counterclockwise motions, such oscillations are not rotations as would be utilized in rotational drilling.

An RSS may drill directionally where there is continuous rotation from surface equipment, which may alleviate the sliding of a steerable motor (e.g., a PDM). An RSS may be deployed when drilling directionally (e.g., deviated, horizontal, or extended-reach wells). An RSS may aim to minimize interaction with a borehole wall, which may help to preserve borchole quality. An RSS may aim to exert a relatively consistent side force akin to stabilizers that rotate with the drillstring or orient the bit in the desired direction while continuously rotating at the same number of rotations per minute as the drillstring.

The module 254 may be an LWD module that may be housed in a suitable type of drill collar and may contain one or a plurality of selected types of logging tools. It will also be understood that more than one LWD module and/or one MWD module may be employed, for example, as represented by the module 256 of the drillstring assembly 250. Where the position of an LWD module is mentioned, as an example, it may refer to a module at the position of the module 254, the module 256, etc. An LWD module may include capabilities for measuring, processing, and storing information, as well as for communicating with the surface equipment. In the illustrated example, the module 254 may include a seismic measuring device.

Where the module 256 is an MWD module (e.g., an MWD tool), it may be housed in a suitable type of drill collar and may contain one or more devices for measuring characteristics of the drillstring 225 and the drill bit 226. As an example, an MWD tool may include equipment for generating electrical power, for example, to power various components of the drillstring 225. As an example, an MWD tool may include the telemetry equipment 252, for example, where one or more turbine impellers may generate power by flow of the mud; it being understood that other power and/or battery systems may be employed for purposes of powering various components. As an example, the module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation may include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well may include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring may include a positive displacement motor (PDM).

As an example, a system may be a steerable system and include equipment to perform method such as geosteering. As mentioned, a steerable system may be or include an RSS. As an example, a steerable system may include a PDM or a turbine on a lower part of a drillstring which, just above a drill bit, a bent sub may be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 may include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 may be provided for tracking pipe, tracking movement of at least a portion of a drillstring, etc.

As an example, the system 200 may include one or more sensors 266 that may sense and/or transmit signals to a fluid conduit such as a drilling fluid conduit (e.g., a drilling mud conduit). For example, in the system 200, the one or more sensors 266 may be operatively coupled to portions of the standpipe 208 through which mud flows. As an example, a downhole tool may generate pulses that may travel through the mud and be sensed by one or more of the one or more sensors 266. In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 may include a transmitter that may generate signals that may be transmitted downhole via mud (e.g., drilling fluid) as a transmission medium.

As an example, one or more portions of a drillstring may become stuck. The term stuck may refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this may refer to a portion of a drillstring that may not be rotated or moved axially. As an example, a condition referred to as "differential sticking" may be a condition whereby the drillstring may not be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking may have time and financial cost.

As an example, a sticking force may be a product of the differential pressure between the wellbore and the reservoir and the area that the differential pressure is acting upon. This means that a relatively low differential pressure (delta p) applied over a large working area may be just as effective in sticking pipe as may a high differential pressure applied over a small area.

As an example, a condition referred to as "mechanical sticking" may be a condition where limiting or prevention of motion of the drillstring by a mechanism other than differential pressure sticking occurs. Mechanical sticking may be caused, for example, by one or more of junk in the hole, wellbore geometry anomalies, cement, keyseats or a buildup of cuttings in the annulus. One or more types of sticking may introduce one or more types of risks, which may be to a borehole wall, equipment, mud, mud flow, etc. In various instances, sticking may introduce non-productive time (NPT), for example, depending on extent of sticking, frequency of sticking, one or more actions taken to reduce sticking, etc.

Figure 3:
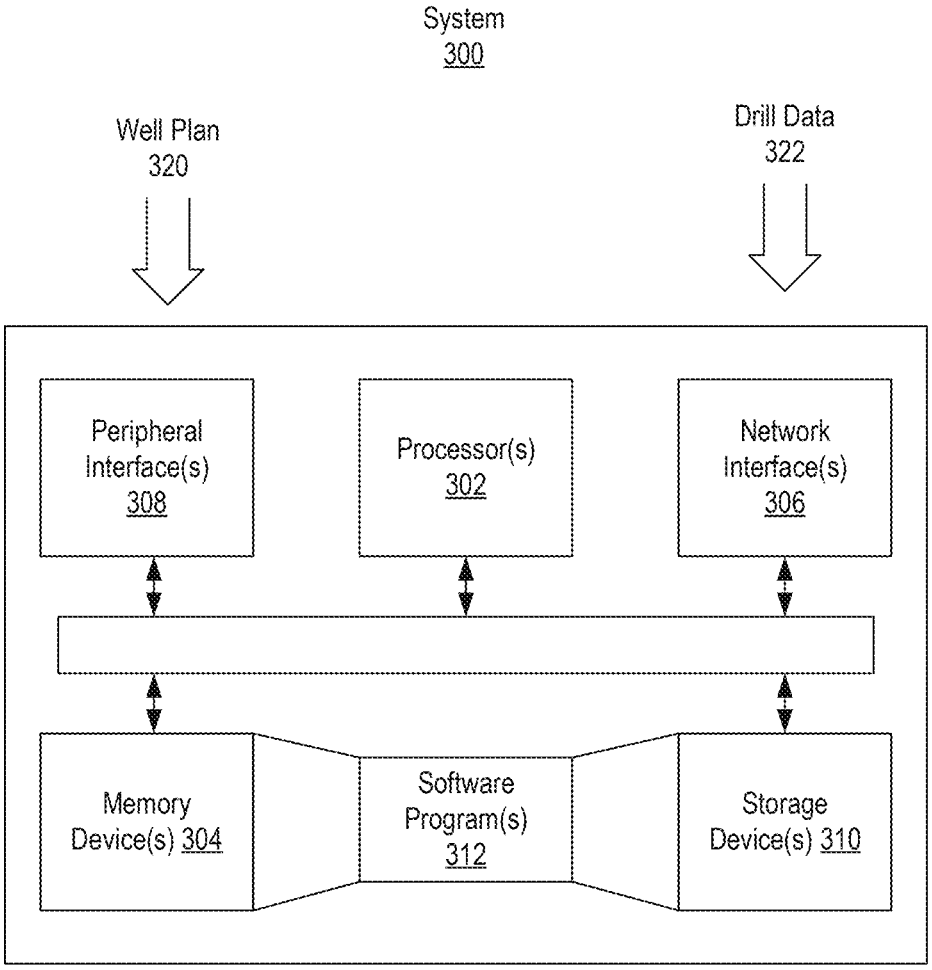
FIG. 3 shows an example of a system.

FIG. 3 shows a schematic view of a computing or processor system 300, according to an embodiment. The processor system 300 may include one or more processors 302 of varying core configurations (including multiple cores) and clock frequencies. The one or more processors 302 may be operable to execute instructions, apply logic, etc. It will be appreciated that these functions may be provided by multiple processors or multiple cores on a single chip operating in parallel and/or communicably linked together. In at least one embodiment, the one or more processors 302 may be or include one or more GPUs.

The processor system 300 may also include a memory system, which may be or include one or more memory devices and/or computer-readable media 304 of varying physical dimensions, accessibility, storage capacities, etc., such as flash drives, hard drives, disks, random access memory, etc., for storing data, such as images, files, and program instructions for execution by the processor 302. In an embodiment, the computer-readable media 304 may store instructions that, when executed by the processor 302, are configured to cause the processor system 300 to perform operations. For example, execution of such instructions may cause the processor system 300 to implement one or more portions and/or embodiments of the method(s) described above.

The processor system 300 may also include one or more network interfaces 306. The network interfaces 306 may include any hardware, applications, and/or other software. Accordingly, the network interfaces 306 may include Ethernet adapters, wireless transceivers, PCI interfaces, and/or serial network components, for communicating over wired or wireless media using protocols, such as Ethernet, wireless Ethernet, etc.

As an example, the processor system 300 may be a mobile device that includes one or more network interfaces for communication of information. For example, a mobile device may include a wireless network interface (e.g., operable via one or more IEEE 802.11 protocols, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope, etc.), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

The processor system 300 may further include one or more peripheral interfaces 308, for communication with a display, projector, keyboards, mice, touchpads, sensors, other types of input and/or output peripherals, and/or the like. In some implementations, the components of processor system 300 need not be enclosed within a single enclosure or even located in close proximity to one another, but in other implementations, the components and/or others may be provided in a single enclosure. As an example, a system may be a distributed environment, for example, a so-called "cloud" environment where various devices, components, etc. interact for purposes of data storage, communications, computing, etc. As an example, a method may be implemented in a distributed environment (e.g., wholly or in part as a cloud-based service).

In the example of FIG. 3, the memory device 304 may be physically or logically arranged or configured to store data on one or more storage devices 310. The storage device 310 may include one or more file systems or databases in any suitable format. The storage device 310 may also include one or more software programs 312, which may contain interpretable and/or executable instructions for performing one or more of the disclosed processes (e.g., processor-executable instructions storable in the memory 304 and executable to instruct the system 300 to perform one or more actions). When requested by the processor 302, one or more of the software programs 312, or a portion thereof, may be loaded from the storage devices 310 to the memory devices 304 for execution by the processor 302.

Those skilled in the art will appreciate that the above-described componentry is merely one example of a hardware configuration, as the processor system 300 may include any type of hardware components, including any accompanying firmware or software, for performing the disclosed implementations. The processor system 300 may also be implemented in part or in whole by electronic circuit components or processors, such as application-specific integrated circuits (ASICs) or field-programmable gate arrays (FPGAs).

The processor system 300 may be configured to receive a directional drilling well plan 320 (e.g., and/or to generate a directional drilling well plan). As discussed above, a well plan is the description of the proposed wellbore to be used by the drilling team in drilling the well. The well plan typically includes information about the shape, orientation, depth, completion, and evaluation along with information about the equipment to be used, actions to be taken at different points in the well construction process, and other information the team planning the well believes will be relevant/helpful to the team drilling the well. A directional drilling well plan may also include information about how to steer and manage the direction of the well.

The processor system 300 may be configured to receive drilling data 322. The drilling data 322 may include data collected by one or more sensors associated with surface equipment or with downhole equipment. The drilling data 322 may include information such as data relating to the position of the BHA (such as survey data or continuous position data), drilling parameters (such as weight on bit (WOB), rate of penetration (ROP), torque, or others), text information entered by individuals working at the wellsite, or other data collected during the construction of the well.

In one embodiment, the processor system 300 is part of a rig control system (RCS) for the rig (e.g., including downhole equipment operatively coupled to the rig). In another embodiment, the processor system 300 is a separately installed computing unit including a display that is installed at the rig site and receives data from the RCS. In such an embodiment, the software on the processor system 300 may be installed on the computing unit, brought to the wellsite, and installed and communicatively connected to the rig control system in preparation for constructing the well or a portion thereof.

In another embodiment, the processor system 300 may be at a location remote from the wellsite and receives the drilling data 322 over a communications medium using a protocol such as well-site information transfer specification or standard (WITS) and markup language (WITSML). In such an embodiment, the software on the processor system 300 may be a web-native application that is accessed by users using a web browser. In such an embodiment, the processor system 300 may be remote from the wellsite where the well is being constructed, and the user may be at the wellsite or at a location remote from the wellsite.

As explained, drilling fluid (e.g., mud) may be provided in tanks (e.g., pits) where drilling fluid may flow from one or more tanks to one or more other tanks, from one or more tanks to a borchole and/or from a bore to one or more tanks (e.g., directly and/or indirectly). As an example, a function of drilling fluid may be pressure control. For example, drilling fluid may be within a borchole and provide pressure to control fluid behaviors. Such pressure may depend on one or more characteristics of the drilling fluid such as, for example, density. In various instances, a pressure applied by drilling fluid may be computed, for example, using a pressure head equation. In fluid mechanics, pressure head may be defined as a height of a liquid column that corresponds to a particular pressure exerted by the liquid column on the base of its container. As an example, a pressure head may be determined for drilling fluid where the pressure exerted by the drilling fluid at a bottom hole position of a borehole may be determined. In such an example, if the pressure exerted is greater than a formation pressure of formation fluid, then the formation fluid may not flow into the borehole (e.g., a wellbore).

As an example, if formation pressure increases, mud density may be increased to balance pressure and that may keep the wellbore stable. As an example, an unbalanced formation pressure may cause an unexpected influx (e.g., a kick) of formation fluid into the wellbore. In various instances, if such an influx (e.g., a kick) is not appropriately addressed, a risk of a blowout may increase where a blowout may possibly occur.

As an example, a method may include computing hydrostatic pressure using a density of drilling fluid, a true vertical depth (TVD), and an acceleration of gravity. In such an example, if hydrostatic pressure is greater than or equal to a formation pressure, formation fluid may not flow into a wellbore.

As an example, a system may provide for well control such that no uncontrollable flow of formation fluid enters a wellbore. In such an example, such a system may include one or more features associated with drilling fluid (e.g., mud). For example, consider a system that may provide for determination of one or more pit states for pits (e.g., tank states for tanks) that may include drilling fluid or drilling fluids. In such an example, a system may provide for well control via selection of drilling fluid, transferring drilling fluid, adjusting a drilling fluid, adjusting a flow rate of one or more drilling fluids, etc. As explained, well control may depend on drilling fluid. In various instances, drilling fluid may be limited such that well control may account for one or more limitations. For example, consider an offshore scenario where a limited amount of drilling fluid may be available and where provision of additional drilling fluid may demand a substantial amount of time (e.g., for shipping the additional drilling fluid to the offshore site).

As an example, drilling fluid may be utilized for hydrostatic pressure control in a manner that aims to control stress from tectonic forces, which may render a wellbore unstable even when formation fluid pressure may be balanced.

As an example, where formation pressure may be subnormal, one or more of air, gas, mist, stiff foam, low density mud (e.g., oil based) may be utilized.

As an example, density of mud may be adjusted for one or more purposes. For example, consider adjusting density of mud to a minimum value that allows for suitable well control and that allows for suitable wellbore stability. As to the latter, if a mud density is too great, there may be a risk of fracturing a formation.

As explained, pit states (e.g., tank states) may be defined that may facilitate one or more operations, which may include well control. As an example, a pit state may depend on a rig state and/or may be discerned at least in part based on one or more rig states. For example, in the context of a rig state, a particular rig state may involve pumping of mud pumps or not pumping of mud pumps. As an example, one or more pit states may be independent of one or more rig states.

As an example, a framework may be a computational framework that provides for well control using pit states. For example, one or more pit states and/or one or more pit state transitions may be indicative of a condition or conditions that may be addressed by well control. For example, consider an indication of kick where well control may be implemented responsive to the indication of kick. In such an example, by addressing kick appropriately, risk of blowout may be reduced. Where a risk of blowout increases, a framework may call for taking one or more actions that may be associated with addressing blowout. For example, consider a framework that may call for preparation of one or more blowout preventers (BOPs), which may include one or more types of rams, etc., that may be actuated to block flow from a wellbore.

As an example, a framework may utilize defined pit states associated with one or more volumes of drilling fluid (e.g., mud). As an example, a drilling fluid volume may increase, which may be referred to as a gain in volume or simply a gain. As an example, a drilling fluid volume may decrease, which be referred to as loss in volume or simply a loss. As to a gain, it may be caused by a flow of formation fluid into a wellbore. As to a loss, it may be caused by a flow of drilling fluid into a formation. As explained, whether formation fluid flows into a wellbore or whether drilling fluid flows into a formation may be based on one or more pressures, fluid characteristics, formation characteristics, etc.

As to a loss, if a loss is not addressed promptly, the loss may impact wellbore integrity. For example, where drilling fluid flows from a wellbore (e.g., a borchole) into a formation, the flow may degrade the formation and hence a wall of the wellbore (e.g., a borchole wall). As to a gain, if a gain is not addressed promptly, the gain may confound or complicate well control; noting that a gain may also impact wellbore integrity. As explained, if losses become substantial, where drilling fluid may be limited (e.g., a limited volume), then making up for losses may diminish the volume of drilling fluid such that well control becomes impacted. In a scenario where it may take a substantial amount of time to provide additional drilling fluid, timings may be impacted, which may introduce non-productive time (NPT), other waste and/or increased risk (e.g., as to an ability to provide well control, etc.).

Mud Volume Balance Context States

In one embodiment, a computing system may be used to facilitate estimating the expected behavior of mud pits based on the understanding of the operational context. The behavior and/or states that are processed may enable the application of conditional alarms to detect unexpected drilling fluid conditions such as gain or losses in a mud pit system.

Properly interpreting mud pits may involve understanding expected state of a system, and whether actual behavior matches the expected behavior. As an example, a set of rules for alarms that might be appropriate in one operational context may not be the appropriate set of rules for alarms in another context. Appropriately matching a set of alarms to the appropriate context may help to ensure that the alarms will provide the relevant personnel and systems with meaningful information. As explained, a framework may provide for well control using one or more pit states. In such an example, the framework may, responsive to an alarm, issue one or more instructions to one or more pieces of field equipment to perform an action or actions, which may facilitate well control (e.g., address a loss, a gain, etc.).

As an example, a framework may be used to detect abnormal gains or losses in mud pits. As an example, a method may involve defining expected behavior of active pits with respect to changes in mud flow rate into one or more of the pits. In one embodiment, a set of states may be detected based on mud flow rate into one or more of the pits. In one embodiment, an approach may use active mud pits (e.g., one or more mud pits that are deemed active).

FIG. 4 shows an example of a table 400 that illustrates one example of an approach to determining a tank state (e.g., a pit state). In FIG. 4, the table shows various pit states (Down, Stable, Transient, Up, Zero, Unknown, Unstable, Downlink, etc.) along with the pumping action and expected active volume change in each particular state. For example, the "Down" state represents the state where the flow rate is staging down and the active pits are expected to change. In this particular state, the pumps are pumping drilling fluid down and the active volume change is expected to increase. In the "Stable" state, the flow rate is stable and active pits are expected to be in a stable condition with the pumps pumping drilling fluid and the expected active volume being stable. In the "Up" state, the flow rate is staging up and the active pits are expected to change. In the "Zero" state, the flow rate is zero, as the pumps may be off (e.g., no pumping). As explained, various tank states may be defined with respect to one or more pumping operations of one or more pumps (e.g., consider staging down, staging up, pumps on, pumps off, etc.).

The approach in the example of FIG. 4 may estimate a transient period or periods where the active pits are not stable. This may be due, for example, to the draining of filling surface lines based on the level of flowrate change. The duration of the transient periods may be accumulated until the lines are fully drained or reach their expected level. The approach may calculate the time to fully drain or fill the flow line and output the period where the pits are expected to be in an unstable condition.

An approach may also detect when the flowrate is changing as it impacts on active pits and on the flow out measurement located at the flow line. It may also compute a period where the active pits are expected to be stable with mud flow rate and without mud flow rate.

Different alarm sets and/or control actions may be associated with different states. As a result, alarms that are not relevant for the particular state and that might, for example, generate false positives, may be disengaged for one or more states where they are not appropriate. For example, one set of alarms may be used for detecting gains and losses effectively in states 1 (Stable) or 4 (Zero) of FIG. 4 when the active pits are expected to be stable. This set of alarms may be inappropriate for states such as 0, 2, 3, and 6 when the active pit volumes may be expected to change. As an example, a change in tank volume may be detected based at least in part on tank state. For example, for a detected tank state, expected behavior may be indicated and a computational technique may be associated with the detected tank state that accounts for the expected behavior.

As an example, an approach may actively monitor a drilling fluid circulating system (e.g., drilling fluid system) and associate the drilling fluid circulating system with a state based on the activity. For example, the state may be one of those shown in FIG. 4. After assigning the drilling fluid circulating system a state (e.g., a pit state), the system may select one or more alarms and/or control actions that are associated with that state and deemed valid for that state. The one or more alarms and/or control actions associated with the state may then be activated. The system may also monitor the drilling fluid circulating system for changes in state. In response to determining that the drilling fluid circulating system state has changed, the system may activate one or more of different alarms that are associated with the new state, and deactivate one or more alarms that are associated with the previous state but not the new state. As explained, a framework may provide for one or more well control actions, which may be prompted by issuance of an alarm.

As an example, a framework may utilize a pit state-based (e.g., tank state-based) approach to selection of one or more computational techniques for assessing whether a loss or a gain is occurring or has occurred. For example, various pit states may be associated with one or more field operations that may result in a change in volume of mud in one or more pits. As explained, a change may be expected where the type of change is associated with a pit state. In such an approach, a framework may utilize a pit state-based approach that selects an appropriate computational technique, which may be physics-based, machine learning-based, hybrid, etc., to assess whether a loss or a gain is occurring or has occurred. As an example, a framework may operate in a real-time manner or near real-time manner in making determinations as to whether a loss or a gain is occurring or has occurred. As to a near real-time manner, consider a delay that may include transmission, computation, etc., time. As an example, a framework may implement a delay or delays that may provide for enhanced determinations and/or robustness. As an example, a framework may provide for output as to a gain or a loss within a period of time that may be less than a number of minutes (e.g., less than five minutes). In such an example, output may depend on a pit state and/or a pit state transition, where a pit state may involve one or more types of field operations that may take a particular amount of time (e.g., line draining, line filling, mud transfer, etc.).

As an example, a framework may automatically determine a pit state based on one or more inputs, which may include one or more sensor-based inputs (e.g., sensor measurements, etc.). As an example, a framework may automatically detect a pit state, as associated with mud flow, active volume of mud, etc. In such an example, input to detect a pit state may include one or more hoisting system inputs (e.g., block position and hookload with respect to time), bit depth, flow rate, etc. For example, consider a framework that may receive block position and hookload where such values are sampled at approximately once per 5 seconds. As to bit depth, it may provide an indication of how much mud is in a borehole (e.g., wellbore) and/or may provide an indication as to a block position with respect to a stand of drillpipe. As to flow rate, it may provide an indication as to mud leaving and/or mud entering one or more pits. As an example, a framework may utilize one or more parameters that may be operational parameters. In various examples, a framework may include operational parameters that influence mud volume and, for example, not those that may not influence mud volume. As to a number of pit states, a framework may utilize more than three pit states and less than approximately 15 pit states. As an example, a framework may utilize approximately four to six pit states. As an example, a framework may utilize pit states that include stable pit states and dynamic pit states. As an example, a framework may utilize an unknown pit state that may provide for robustness, for example, where detection of a predefined state may be problematic. In such an example, a framework may issue one or more instructions, warnings, etc., where detection results in the unknown pit state.

Figure 5:
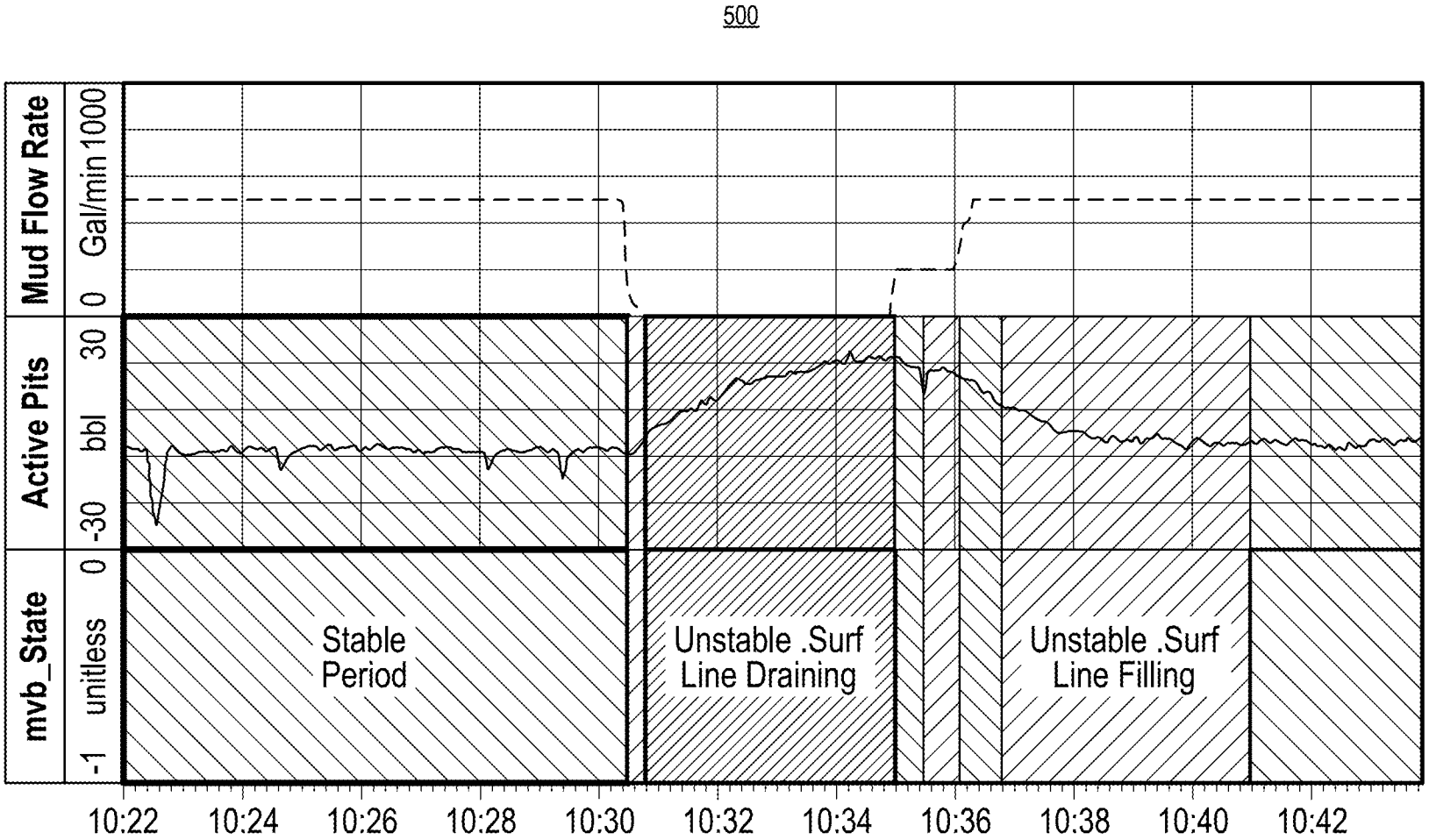
FIG. 5 shows an example of a graphical user interface.

FIG. 5 illustrates a graphical user interface (GUI) 500 of an example of pit states during a drilling connection. In FIG. 5, channels are illustrated with respect to time where the channels include mud flow rate (e.g., 0 to 1000 gallons per minute), volume of active pits (e.g., plus and minus 30 bbl), and a state channel that indicates various pit states with respect to time (e.g., via a single pit state at a given time).

In FIG. 5, the unstable state and the transient state correspond to the expected period to drain and fill the flow line (e.g., a transient period). The stable state areas indicate periods of expected stability in pits and in flow rate. The down state and up state indicators correspond to the change in flow rate, respectively down and up. As explained, a state such as a pit state may be a state that depends on context. As explained, a pit state may provide for assessment of a gain and/or a loss.

In the example of FIG. 5, the volume of the active pits increases during the unstable state time period associated with line draining but then decreases during the unstable state time period associated with line filling. In comparing the volume of the active pits before and after the unstable state time periods demonstrates that the difference is relatively small (e.g., less than a few barrels of mud). In such an example, the gain and subsequent loss were transient and associated with line draining and line filling rather than a downhole condition such as influx of formation fluid or outflow of mud. As shown in FIG. 5, the line draining and the line filling operations take approximately 10 minutes to perform and, for example, the stable periods may be a number of minutes in duration.

Figure 6:
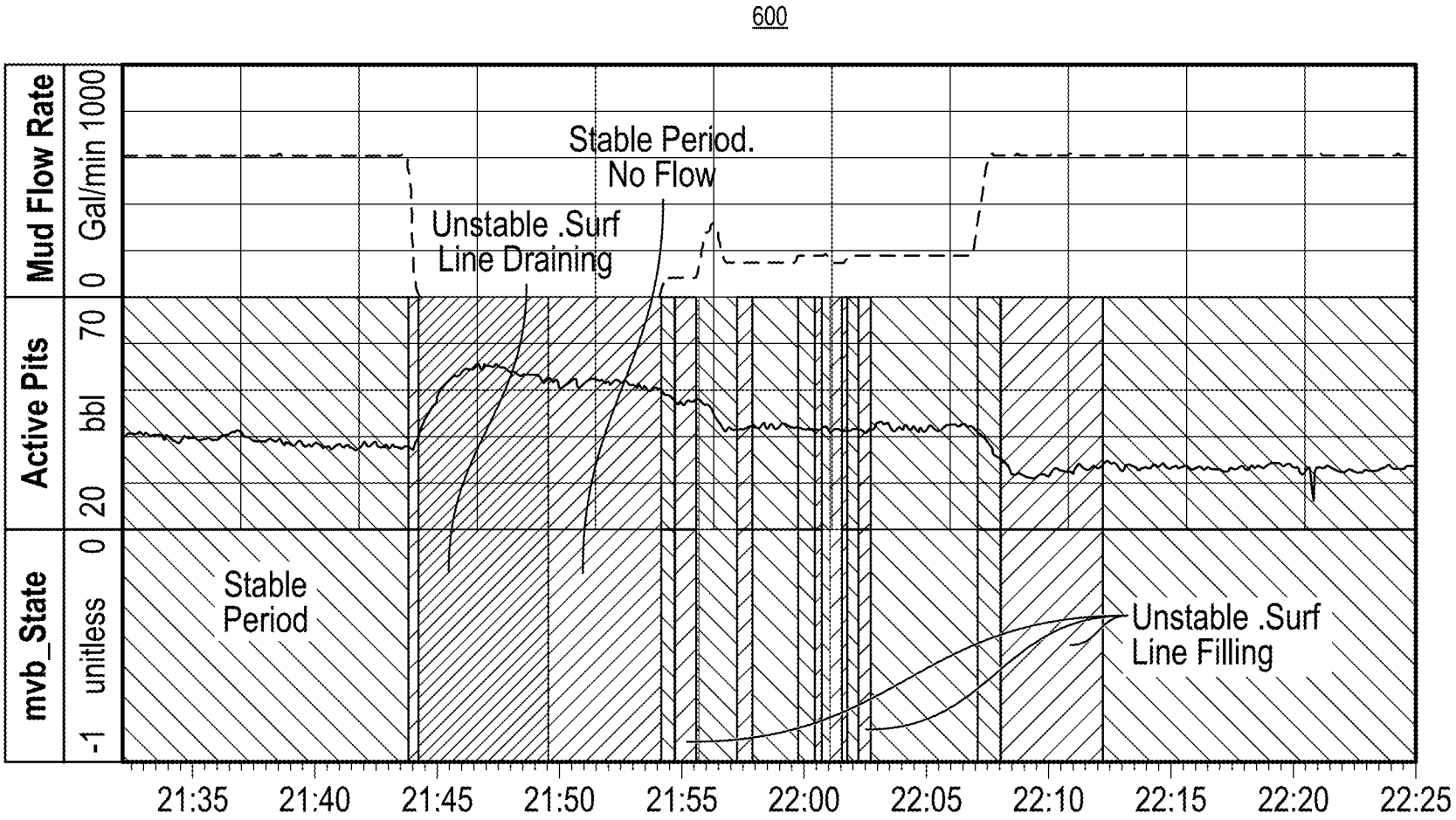
FIG. 6 shows an example of a graphical user interface.

FIG. 6 illustrates an example of a GUI 600 for state definition during a long connection with multiple steps to stage up the flow rate. The transient state time periods in FIG. 6 illustrate periods of transient behavior due to the multiple stage ups with the mud flow rate. In the GUI 600, the channels include mud flow rate (e.g., 0 to 1000 gallons per minute), active pit volume (e.g., 20 bbl to 70 bbl), and state. In the example of FIG. 6, the results indicate that a gain has not occurred; however, there is an indication of a loss. In such an example, the loss may be determined by comparing active pit volume during the first stable period and the last stable period in the GUI 600, which indicates a loss of approximately 5 barrels (bbl), which may be compared to a threshold, for example, to trigger issuance of a signal (e.g., an alarm, a communication, a control instruction, etc.). As explained, a loss may be associated with flow of mud from a wellbore into a formation. Further, the GUI 600 of FIG. 6 demonstrates how various operations may cause changes in active pit volume (e.g., of one or more active pits) that may be difficult for a human to track and/or make one or more determinations. As explained, an automated pit state detection framework may operate to detect a pit state and select an appropriate technique to assess one or more characteristics of mud operations to reach a determination as to whether a change in volume of mud is expected or unexpected where, for example, if unexpected may trigger issuance of a signal (e.g., indicative of a gain or a loss).

The system may use a variety of values for determining a rig state. In drilling a well, there is typically a plan that specifies particular activities at particular depths and/or times. In one embodiment, the system may use plan information along with flow rate information to determine a pit state. Additional information and sensor values may also be used to determine and define pit states (e.g., tank states) such as those specified in FIG. 4. In addition, states may be further decomposed. For example, while the above example uses mud flow rate in as an input, more states may be added. For example, state 4 (Zero) may be decomposed to account for with or without pipe movement, state 1 (Stable) may be decomposed to with or without cutting return, etc.

As discussed above, this approach may define a set of actions that may occur during a drilling operation that affect mud volume balances within one or more areas of a drilling fluid circulating system and assigning such actions to one or more states. The approach may involve associating these states with expected drilling fluid volumes and expected changes to the drilling fluid volumes while the state is active. The approach may also involve defining one or more sets of alarm and/or control conditions for the drilling fluid circulating system, and associating alarm conditions and alarm triggers with the different drilling fluid volume states. In real-time, the system may monitor the states and selectively activate and deactivate alarms, control instructions, etc., based on the state. As explained, a framework may provide for more informative and meaningful alarms and/or controls and, for example, may reduce instances where false positive, or missed alarms, may occur.

Mud Volume Gain Detection During Circulation

As discussed above, determining whether or not to raise an alarm based on changes in the drilling fluid volumes and the drilling fluid circulating system may be challenging. As an example, a framework may provide for determining when there is a fluid loss or a fluid gain in one or more pits that merits generating an alarm and/or a control action. In one embodiment, the approach measures the total active volume of drilling fluids and the sum of volumes to distinguish between fluid gains due to, for example, transfers between pits (e.g., which may be deemed expected behavior and not meriting an alarm and/or control action) and those associated with the formation (e.g., which may be deemed unexpected behavior meriting an alarm and/or control action). For example, when applied to active volume, e.g., the combination of all of the pit volumes that are fed into the well by the mud pump, and to the combination of all the pit volumes of the rig, the approach may help distinguish between fluid gains from a formation and those from mud transfers from reserve pits to active pits.

In one embodiment, an approach may detect gains in a volume of interest using a dynamic window approach for detecting statistically significant volume gains within the volume of interest. In one embodiment, an approach may be applied to an active volume measurement and a total volume measurement. As a result, such an approach may facilitate determining the origin of a gain observed in the active volume and associating it with a possible kick or with an intra transfer of mud within the drilling fluid circulating system. Hence, a framework may operate to distinguish between drilling fluid system operations and drilling fluid formation interactions (e.g., gains or losses).

While various examples aim to address issues such as gain due to flow from a formation and/or loss due to flow to a formation, a framework may provide for determining whether one or more drilling fluid system operations are operating properly. For example, one or more drilling fluid system operations (e.g., draining, filling, etc.) may be specified according to one or more standard operating procedures (SOPs). In such an example, a framework may aim to detect one or more pit states, which may occur in a sequence or sequences, and determine whether compliance with one or more SOPs has been met. In such an example, where a deviation occurs from one or more SOPs, the framework may issue one or more instructions, notifications, etc., to help assure compliance with the one or more SOPs and/or awareness of the deviation. As explained, a framework may include pit states that are associated with expected behaviors, which, for example, may depend at least in part on expected drilling fluid system operations (e.g., one or more SOPs, etc.).

In one embodiment, a gain detection may be triggered by a probable positive gain rate within a relatively short time window prior to a given time. For example, within a time window, a value for the gain rate may be computed. In one embodiment, this time window may be relatively short (e.g., less than 10 minutes). In one embodiment, the time window may be within 2 minutes (e.g., less than or equal to 2 minutes). In one embodiment, if the gain rate is statistically significantly larger than zero within the time window, accumulation of volume backward in time may be initiated.

As an example, volume accumulation may be performed over a dynamic window. In one embodiment, a dynamic window may be initiated with a short window and then enlarged towards the past until the accumulated volume within the window is statistically equivalent to or larger than a set threshold (e.g., consider a threshold of approximately 5 bbl) or a predefined largest window size.

Figure 7:
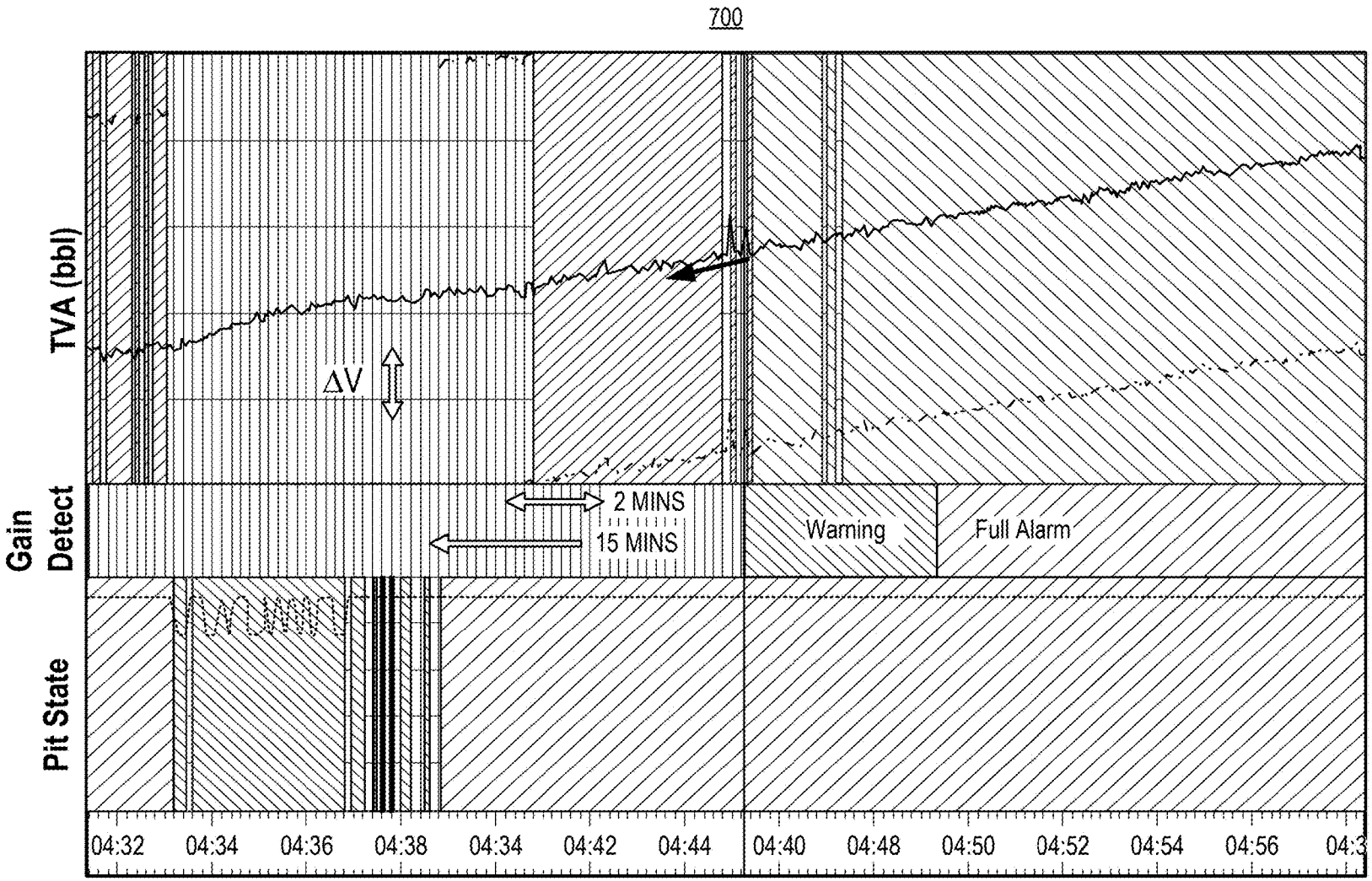
FIG. 7 shows an example of a graphical user interface.

FIG. 7 shows an example of a GUI 700 that illustrates use of various time windows where channels include pit state, gain detect (e.g., alarm, trigger, etc.) and total active volume (TVA) in barrels. In the example of FIG. 7, a fit linear regression on a dynamic backward window to reached a threshold gain (see, e.g., $\Delta V$) may be implemented, as shown (see, e.g., black arrow pointing backwards in time), which may occur multiple times (e.g., in an iterative manner). In another embodiment, a combination of one or more stopping criteria for bounding an enlargement of a dynamic window may be used. For example, trend changes such as sharp, unexpected volume jumps that might be due to unaccounted operational procedures. In the event of a threshold, such as the 5 bbl example, given above, the system may assume confirmation of a gain when the threshold is reached before the predefined largest window size is reached and otherwise not.

Where the threshold is set to 5 bbl, the size of the dynamic window may reflect the duration when the last 5 bbl is gained or exceeded. Dividing the accumulated volume gain with the duration of the dynamic window yields an average rate of gain. In one embodiment, an alarm and/or control action framework may be configured depending on size of an average rate of gain and/or accumulated volume as well. As shown in the example of FIG. 7, the gain detect channel may provide for staging of one or more alarms, control actions, etc. For example, a warning may be issued or indicated in the GUI 700 prior to a subsequent elevated level such as, for example, a full alarm, issuance of a control signal for well control, etc.

Application of the gain detection to the total active volume (TVA) and the sum of all volumes (SumTK) during circulation may be used to generate two sets of temporal gain notifications. Active volume may be inherently present in the sum of the pits. If the gain is present in both the TVA and the SumTK, it may be identified as a gain coming from outside the measured system which, in a regular operation routine, is likely coming from a wellbore and indicates existence of a kick (e.g., formation fluid entering the wellbore). For cases where the gain is present only in the active volume but not in the sum of all of the pits, it may be identified as an intra-transfer of mud among the drilling circulation system such as, for example, a transfer from reserve to active pits. As explained, a framework may distinguish between drilling fluid system operations (e.g., as performed according to one or more operating procedures using equipment) and formation interactions that may result in a gain or a loss.

Figure 8:
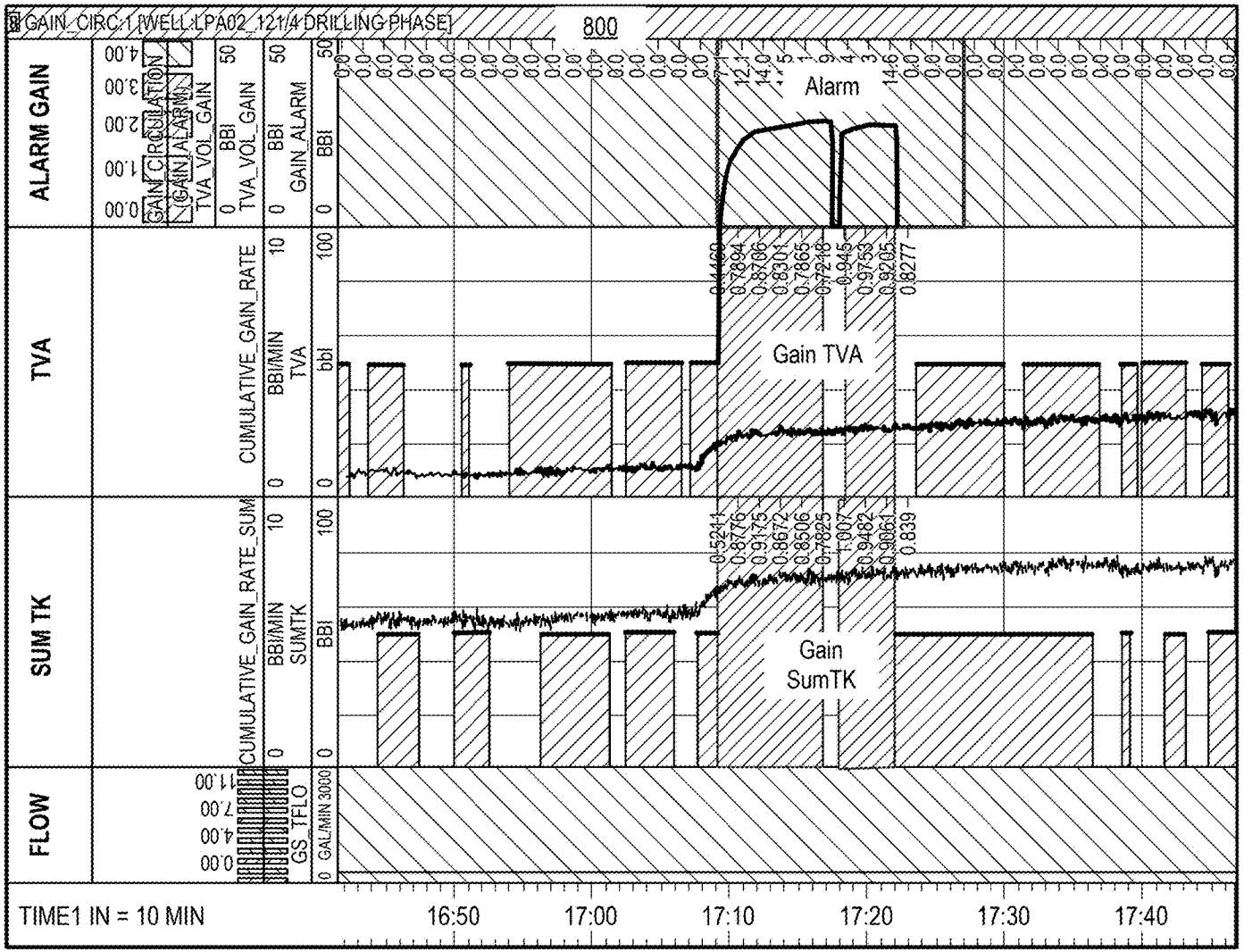
FIG. 8 shows an example of a graphical user interface.

FIG. 8 illustrates an example of a GUI 800 where a gain is detected in active pits (TVA) and sum of all pits (SumTK), both indicators intersect to display an alarm gain from the wellbore (the red interval on the top track). In the GUI 800, channels include flow rate (e.g., gallons per minute), SumTK (e.g., bbl), cumulative gain rate (e.g., bbl per minute) as associated with all pits, TVA (e.g., bbl), cumulative gain rate (e.g., bbl per minute) as associated with active pit(s), and alarm gain, which may be coded with respect to volume (e.g., bbl). As shown, the alarm gain channel indicates an alarm where a gain in volume is indicated by the channels TVA and SumTK.

Figure 9:
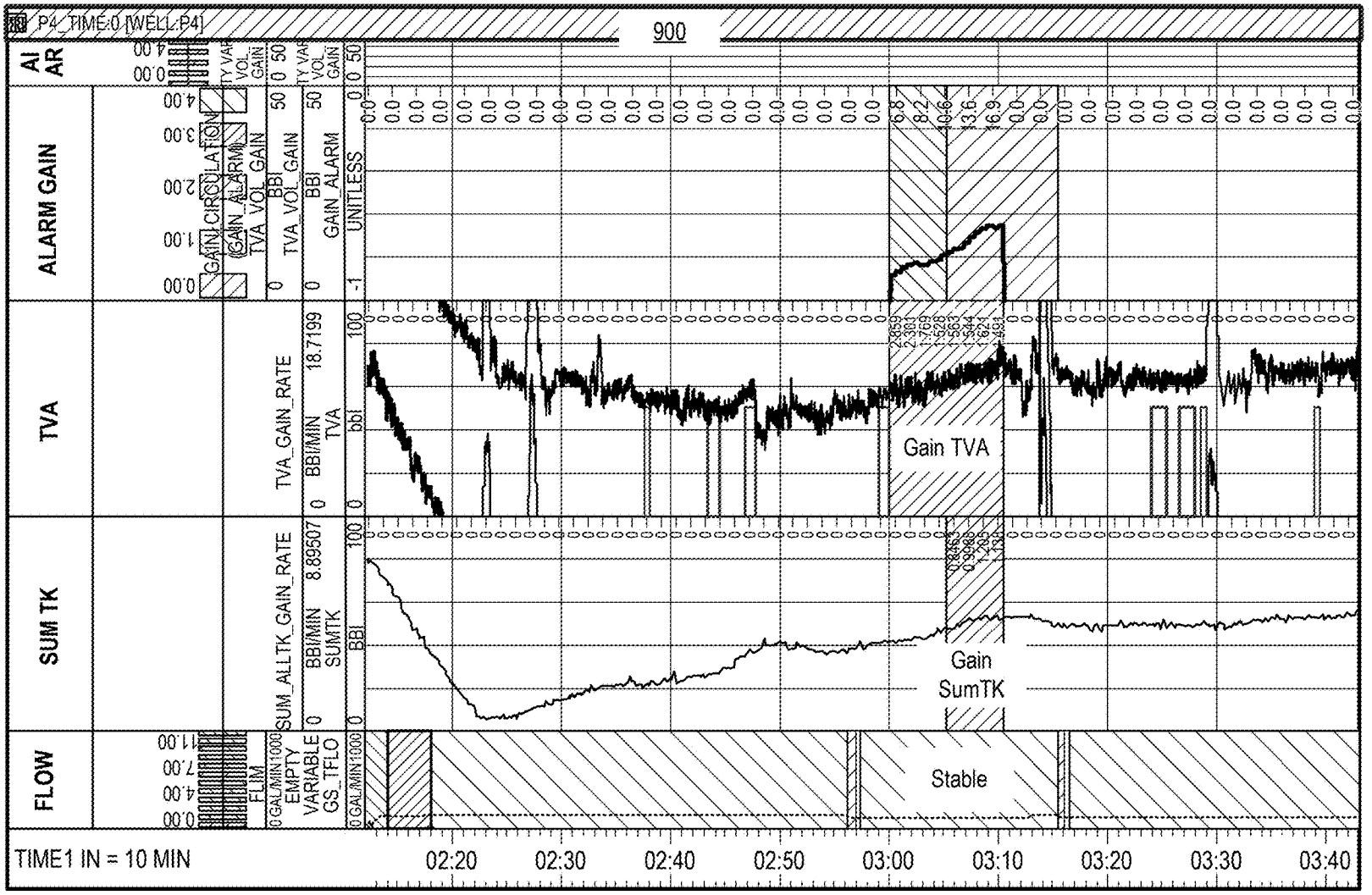
FIG. 9 shows an example of a graphical user interface.

FIG. 9 illustrates an example of a GUI 900 where a gain is detected in active pits (TVA) and sum of all pits (SumTK). Both indicators intersect to cause triggering of rendering of an alarm gain from the wellbore. For example, consider the alarm gain channel as including a color-coded warning (e.g., light red) followed by a full alarm (e.g., dark red), which may be associated with issuance of one or more control instructions to address the gain. In such an example, the warning may be associated with a gain in TVA and the full alarm may be associated with the gain in TVA and the gain in SumTK. As shown, these gains occur during a pit state that is stable. As explained, an alarm and/or a control action may be issued on the basis of detection of one or more gains. For example, one control action or actions may be issued upon detection of one gain (e.g., or loss) for one channel (e.g., TVA) and another control action or actions may be issued upon detection of two gains (e.g., or losses) for two channels (e.g., TVA and SumTK). As explained, a framework may detect pit states and behaviors for multiple aspects of a drilling fluid system that may be associated with surface and/or downhole phenomenon or phenomena.

As an example, the GUI 900 may call for rendering of a popup graphic for a recommended control action that may be implemented by a drilling fluid system to address the gain. The GUI 900 of FIG. 9 also illustrates relatively high noise in the active pits signal (TVA); whereas, the SumTK channel exhibits less noise. In such an example, a framework may operate to assess noise and, for example, to categorize the noise as being associated with a particular type of phenomena, which may be a downhole phenomenon (e.g., formation interaction) or a surface phenomenon (e.g., a drilling fluid system behavior). As an example, a framework may operate to address one or more behaviors, whether downhole or surface.

As explained, a framework may operate to detect a pit state and select one or more computational techniques to assess whether a gain or a loss may be occurring and/or have occurred. Such a framework may operate in an expeditious manner such that one or more control actions may be taken, optionally automatically, for purposes of proper operation of a drilling fluid system, which may be for purposes of addressing a gain or a loss or, for example, for meeting one or more SOPs, servicing equipment, etc.

Figure 10:
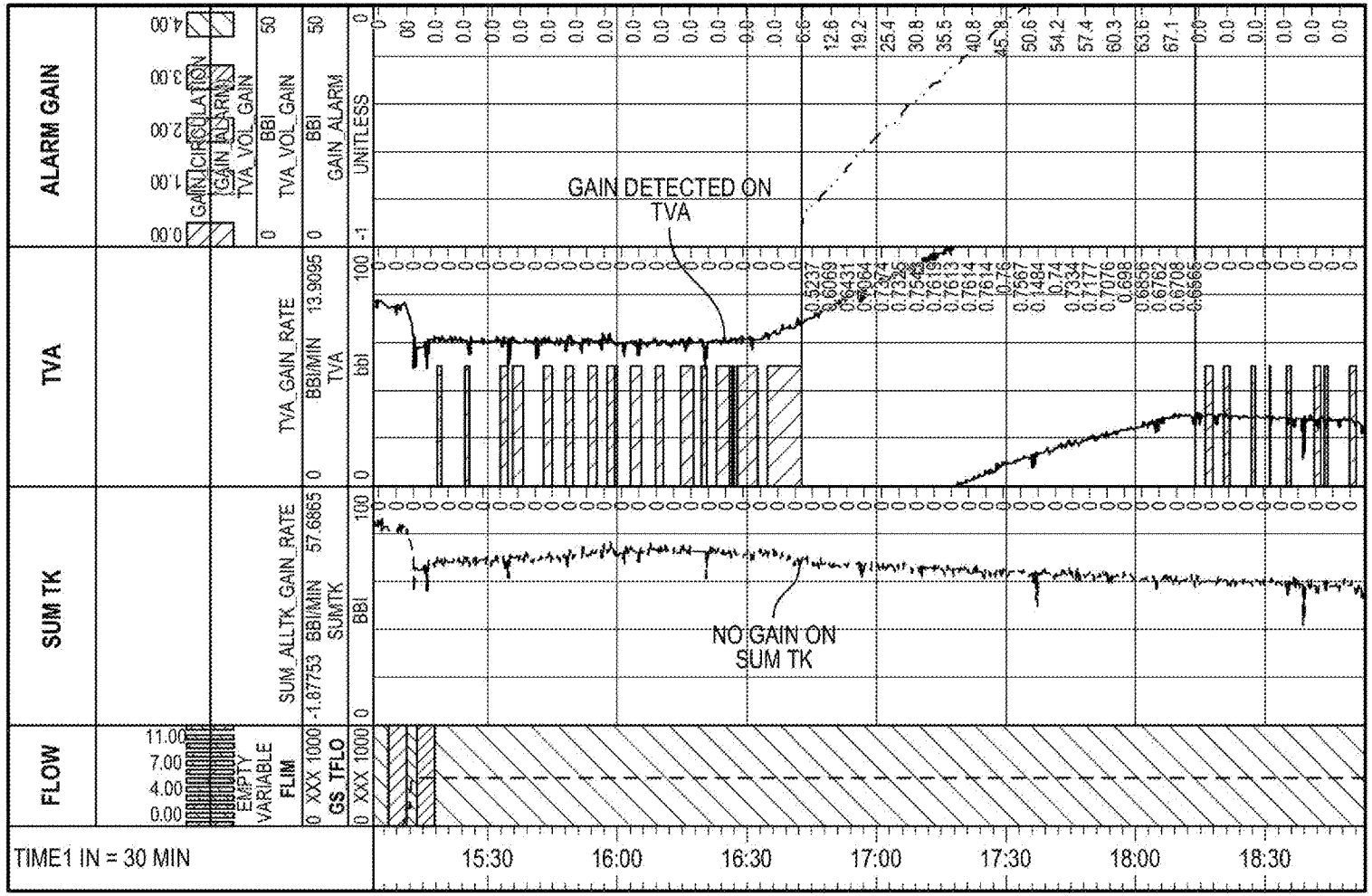
FIG. 10 shows an example of a graphical user interface.

FIG. 10 illustrates an example of a GUI 1000 where a gain detected in active pits (TVA) that is not seen in the sum of all pits (Sum TK). In the example of FIG. 10, these two indicators do not intersect. Hence, a framework may call for issuance of an alarm, a warning, a control action, etc., as to the active pits, which may be associated with a gain due to drilling fluid transfer from a reserve to an active pit (e.g., reserve drops in volume while active gains in volume). As explained, such a transfer may be part of an operating procedure such that the framework may track such a procedure and, for example, determine whether it is performed according to a specified protocol (e.g., an SOP, etc.).

As an example, a drilling fluid system may include a number of pits, which may be greater than two pits, greater than four pits, greater than six pits, greater than ten pits, etc. For example, a rig may include twenty pits. As an example, a framework may provide for processing data associated with a number of pits in an efficient manner. For example, a framework may provide for processing data associated with twenty pits in an efficient manner. In such an example, manual human processing is impractical and would introduce delays that may possibly complicate or confound timely well control action (e.g., to address a loss, a gain, etc.). In general, as the number of pits increases, manual human processing becomes more impractical.

As an example, as to efficiency, as explained, a framework may operate to detect pit state, compute one or more metrics for active pit(s) and compute one or more metrics for all pits. In such an approach, the framework may utilize one or more computational techniques for computation of such one or more metrics in a manner that is agnostic to number of pits (e.g., where number of pits exceeds two pits, etc.). In such an approach, a user interface (e.g., a GUI) may be similarly configured in a manner that is agnostic to pit number. As an example, where a framework provides for assessment of a drilling fluid system, it may provide for identification of one or more pit specific issues (e.g., as to SOPs, etc.). As explained, a framework may have a main function as to providing an indication of a change in drilling fluid (e.g., mud) volume that is indicative of a formation interaction, which may be relevant to well control; noting that well control concerns may include one or more of gains, losses, formation damage, wellbore damage, etc.

Mud Volume Gain Detection Using Flow Out Measurement

As an example, a method may provide for analysis of flow out to detect flow issues and provide relevant notifications such as alarms and/or control actions. In one embodiment, the approach may be used for analyzing paddle flowmeter signals in order to detect fluid influx.

Paddle flowmeters may be sensors installed on drilling rigs on shore and offshore for measuring fluid flow. Paddle flowmeters are frequently used to measure flowout, but tend to be noisy, provide poor accuracy, and often require frequent calibration. As such, using these flowmeters for generating alarms and/or control actions may be difficult to do in a way that is accurate and useful. With these conditions in mind, one approach is to use alarms that may operate in particular conditions and operation, with an approach that prioritizes a stable flow in condition such as drilling activity and dismisses activity with no flow in, with trip tank pump or with change in flow.

In certain embodiments, an approach may involve preprocessing the sensor data. Such processing may be performed for one or more purposes such as, for example, measurement calibration and/or denoising. As an example, preprocessing may occur before performing detection and estimation of deviation of the measurement from stationary behavior. In one embodiment, measurements may be calibrated and mapped within a dynamic range of [0,100]. Values outside the bounds may be treated as faulty and excluded from the computations. In certain embodiments, measurements may be assumed to be missing or corrupted such that no extrapolation is used.

Detection for change may be triggered by a probable deviation from stationarity within a time window prior to a given acquisition time. For example, given an acquisition time $t_0$, the data d(t) within a short time window of duration $T_{short}$ before the acquisition time is fit by linear regression:

$$d(t) \approx at + b,\ t \in [t_0,\ t_0 - T_{short}],$$

Along with the estimated mean ($\mu_a$, $\mu_b$) of the slope and offset parameters (a, b), associated standard deviations ($\sigma_a$, $\sigma_b$) are computed. If the absolute value of the estimated mean slope diverges from a previously defined detection criterion, the approach may start progressively enlarging the short time window towards past until a stopping criterion is met within this enlarging dynamic window. One detection criterion is deviation from a minimum slope $a_{min,short} \geq 0$ within a factor k of the computed standard deviation of the estimated slope:

$$|\mu_a| > a_{min,short} + k\sigma_a.$$

The dynamic window may be initiated as the short window and enlarged towards past by one time sample at a time, until some stopping criteria are met. A stopping criterion for the dynamic window size $T_{dynamic}$ could be a maximum window size $T_{long} > T_{short}$ or an objective that is reached, which may be for a decision to increase or decrease within the dynamic window.

As an example, let $t_i$ denote the ordered time samples within the long time window, e.g., $t_i < t_j$ when i<j, and $N_{short}$, $N_{dynamic}$ and $N_{long}$ denote the number of time samples within the short, dynamic and long time windows excluding the time sample $t_0$, respectively, with $N_{short} \leq N_{dynamic} \leq N_{long}$. For i=1, . . . , $N_{dynamic}$, the data within $[t_0, t_i]$ is fit by linear regression:

$$d(t) \approx a_i t + b_i,\ t \in [t_0,\ t_i].$$

In such an example, for each time sample $t_i \in [t_1, t_{N_{dynamic}}]$, a framework may define the state of the measurement $S(t_i)$ by:

$$S(t_i) = \begin{cases} \text{sign}\ (\mu_{a_i}(t_0 - t_i)) & \text{if } |\mu_{a_i}(t_0 - t_i)| > \Delta b_{min} + k\sigma_{b_i} \\ 0 & \text{otherwise} \end{cases}.$$

Above, $\Delta b_{min}$ is a predefined minimum sensitivity value. As an example, for well calibrated flowout measurements, $\Delta b_{min}$ may be assumed to be between 5-10. The value $|\mu_{a_i}(t_i - t_0)|$ shows the absolute estimated change of the measured signal between $t_0$ and $t_i$, and sign ($\mu_{a_i}(t_i - t_0)$ indicates the sign of the change, e.g., positive when there is an increase and negative when there is a decrease.

In order to ensure consistency and continuity of states, an approach may compare them with continuously increasing and continuously decreasing states. This may be performed by correlating the vector $$S = \left[\ S(t_1)\ \ \ldots\ \ S(t_i)\ \ \ldots\ \ S(t_{N_{dynamic}})\ \right]$$

with $S_{+1}$=[1 . . . 1 . . . 1], if a framework is to detect a consistent increase, or with $S_{-1}$=[−1 . . . −1 . . . −1], if a framework is to detect a consistent decrease. In such an example, note that the minimum and maximum length that the vector S may be $N_{short}$ and $N_{long}$, respectively.

As an example, one way to determine consistent behavior of S follows. For example, first note that L1 and square of L2 norms of the vector S:

$$|S|_1 = \sum_{i=1}^{N_{dynamic}} |S(t_i)| = \sum_{i=1}^{N_{dynamic}} |S(t_i)|^2 = |S|_2^2$$

and are less than $N_{dynamic}$ and more than correlation of $|S \cdot S_{\pm 1}|$:

$$|S \cdot S_{\pm 1}| \leq |S|_1 = |S|_2^2 \leq S_{\pm 1} \cdot S_{\pm 1} = |S_{\pm 1}|_1 = |S_{\pm 1}|_2^2 = N_{dynamic}$$

Thus, in such an example, consider:

$$0 \leq \frac{|S \cdot S_{\pm 1}|}{N_{dynamic}} \leq 1$$

Above, equality to 1 holds when $S = S_{\pm 1}$. Consequently, the following decision criteria may be employed for deciding increase and decrease.

As an example, denoting the decision at time $t_0$ by $D_0$, consider the following definition:

$$D_0 = \begin{cases} 1\text{: increase} & \text{if } \frac{S \cdot 1}{N_{dynamic}} > .5 \\ -1\text{: decrease} & \text{if } \frac{S \cdot (-1)}{N_{dynamic}} < -.5 \\ 0\text{: stationary} & \text{if } \left|\frac{S \cdot 1}{N_{dynamic}}\right| < .5 \end{cases}$$

As an example, in an alternative manner, consider:

$$D_0 = \begin{cases} \text{sign}\left(\sum_{i=N_{short}}^{N_{dynamic}} S(t_i)\right), & \text{if } \left|\sum_{i=1}^{N_{dynamic}} S(t_i)\right| > \frac{N_{dynamic}}{2} \\ 0, & \text{otherwise} \end{cases}.$$

As an example, once a decision of an increase or a decrease is made by a framework, the decision may be incorporated into a larger decision workflow, for example, for issuance of an alarm, a warning, a control action, etc.

As an example, a framework may use a combination of one or many stopping criteria for bounding enlargement of a dynamic window, for example, consider one or more trend changes such as one or more sharp unexpected volume jumps, which could be due to unaccounted operational procedures. In the case of a threshold as discussed above, a framework may assume confirmation of a deviation from stability when the threshold is reached before a predefined largest window size is reached and otherwise not.

The size of a dynamic window may reflect the duration when the changed started to occur. As an example, dividing an amount of change with the duration of a dynamic window, a framework may obtain an average rate of change. As an example, an alarm or control action process may be designed depending on the size of an average rate of gain and/or accumulated volume.

Figure 11:
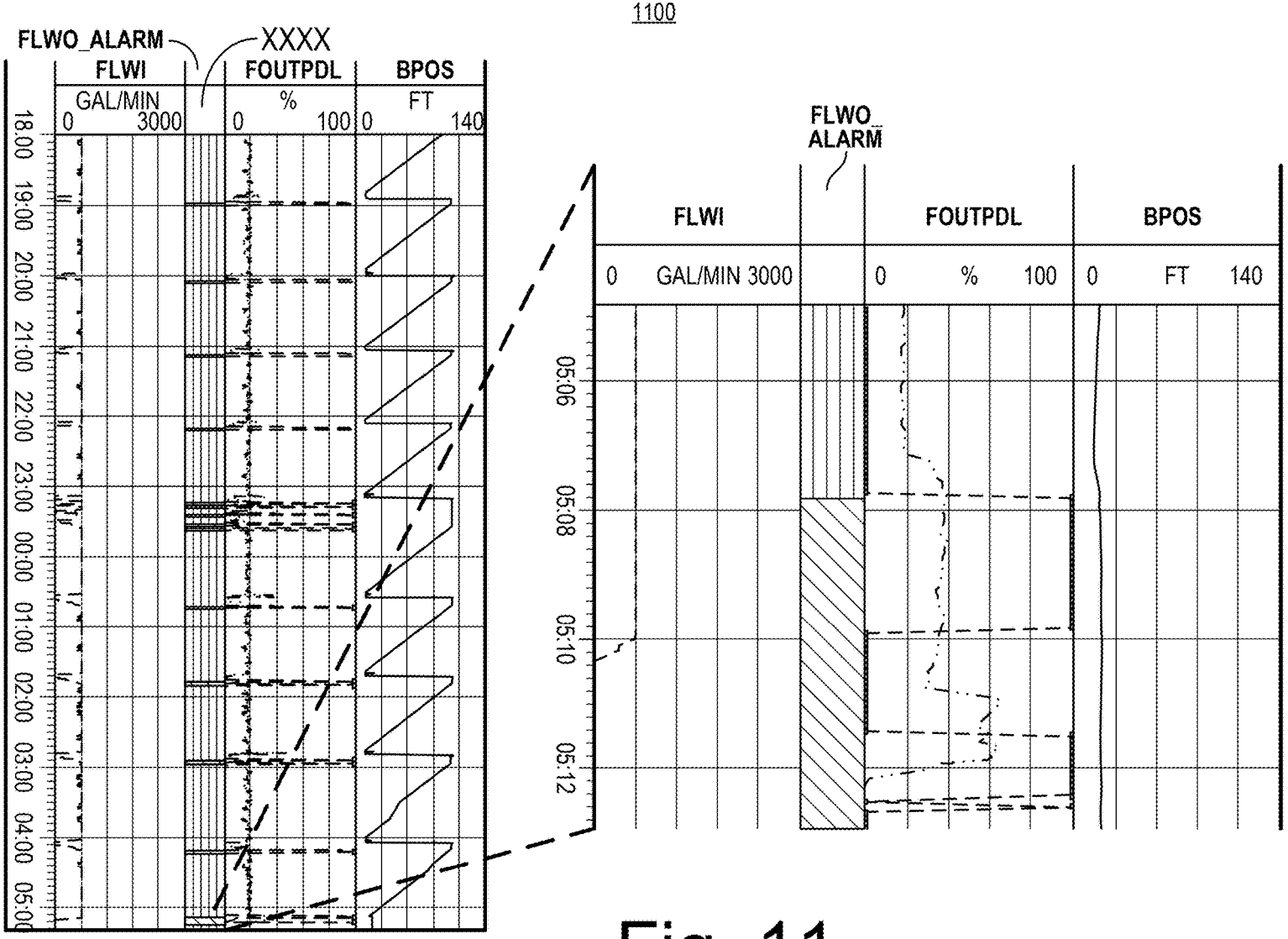
FIG. 11 shows an example of a graphical user interface.

FIG. 11 shows an example GUI 1100 with an enlarged portion. In FIG. 11, the GUI 1100 illustrates behavior of a computational technique and alarm and/or control action generation. In the example of FIG. 11, the flow out states are coupled with the behavior of the flow in to raise alarm and/or control action. In the example GUI 1100, an alarm represented in a particular interval to indicate an influx from the wellbore, various other intervals indicate abnormal flow out due to change in flow in, which do not trigger an alarm. More specifically, in FIG. 11, the flow out alarm is shown during a drilling operation. The influx is detected prior to a last connection (sec corresponding interval). As to the enlarged portion of the GUI 1100, it is a zoom-in on the influx where the particular interval represents an alarm, which may trigger one or more control actions (e.g., for well control). In the example of FIG. 11, the GUI 1100 includes various channels, which may include, for example, flow rate, flowout, and block position (BPOS), which may exhibit how stands of drillpipe are moved either into or out of a wellbore. As shown, a flow alarm and/or control action channel may be included in such a GUI.

Real-Time Automatic Notification of Abnormal Gain in Active Pit in the Context of a Short Connection As an example, a framework may provide for detecting abnormal gain in an active pit or pits in the context of short connections, which may provide for improved safety and integrity of one or more wellsite operations. As an example, abnormal gain in an active pit or pits may be investigated during various drilling phases where, for example, detection of one or more gains may trigger one or more real-time alarms and/or control actions. As an example, a framework may provide for rendering of one or more GUIs that allow engineers to examine several active wells at the same time, which may, for example, reduce the probability of having a kick which may lead to a catastrophic event at one or more rig sites.

As an example, a framework may provide for monitoring one or more active pits while drilling such that a team may assure that one or more actions are implemented (e.g., automatically, semi-automatically, manually, etc.) in an effort to reduce risk of one or more catastrophic events at a rig site. As an example, a framework may provide for monitoring one or more active pits in the context of a connection, which may provide for generation of and use of a flowback fingerprint. In such an example, an individual or a team may check an active pit response for a connection and compare it with one or more previous connections (e.g., or combinations thereof). In various instances, however, such a process may be insufficient for one or more specific cases, for example, consider one or more instances where a connection is too short to compute an effective flowback fingerprint.

As an example, a framework may provide for implementation of real-time automation of abnormal gain in one or more active pits in the context of a relatively short connection. In one embodiment, the beginning of a connection based on a flow in signal response may be identified, the reference volume of the active pit(s) before the connection may be identified, then a check that the connection is properly performed may be implemented, for example, by examining whether the rig was on slips (e.g., in-slips or inslips). Such an approach may then apply one or more conditions on a measured connection time, bit depth difference and flow rate comparison to discard connections that lack coherence (e.g., do not rationally make sense). Such an approach may also identify the active pit volume after the connection and trigger a real-time alarm and/or control action if the difference between the 2 connections is greater or equal to a threshold amount (e.g., 5 bbl). Such an approach may also suppress an alarm and/or control action if there is a mud transfer in the active pit by looking at the total volume of all pits.

As an example, an approach implemented by a framework may provide a solution to automatically detect abnormal gain in one or more active pits with relatively short connections in real-time. In such an example, the framework may provide for detecting gain when a flowback fingerprint is insufficient and provide an automatic computation that provides users with a clear indication of the active pit(s) and that raises an alarm automatically and/or control action (e.g., automatically, semi-automatically, etc.).

In one embodiment, an approach may use one or more of the following input channels: absolute Time [s]; rig state [unitless]; pit state [unitless]; mud flow in rate [m3/s]; bit depth [m]; active pit volume [m3] and sum of volume of all pits [m3].

As an example, such an approach may provide the following outputs:

| Channel | Description | Sample Mnemonic |
|---|---|---|
| Flow in before [m3/s] | MVBC mud flow in rate at reference point before inslips period | FLWI_BEFORE_MVBC |
| Flow in after [m3/s] | MVBC mud flow in rate at reference point after inslips period | FLWI_AFTER_MVBC |
| Flow in percentage difference [%] | MVBC mud flow in rate percentage difference between the reference points before and after inslips period | FLWI_DIF_PERC_MVBC |
| Flow in difference [m3/s] | MVBC mud flow in rate difference between the reference points before and after inslips period | FLWI_DIF_RATE_MVBC |
| Active pit volume before [m3] | MVBC active volume at reference point before inslips period | TVA_BEFORE_MVBC |
| Active pit volume after [m3] | MVBC active volume at reference point after inslips period | TVA_AFTER_MVBC |
| Active pit volume difference [m3] | MVBC active volume difference between the reference points before and after inslips period | TVA_DIF_MVBC |
| Bit depth difference [m] | MVBC bit depth difference between the reference points before and after inslips period | DBTM_DIF_MVBC |
| Duration between before and after reference points [min] | MVBC duration between the reference points before and after inslips period | DURATION_MVBC |
| Active pit connection alarm [unitless] | MVBC alarm indicates if a loss or a kick is happening around inslips period; binary value: 0: no alarm, 1: alarm | ALARM_MVBC |

Such an approach may detect abnormal gain in one or more active pits in the context of a short connection.

Figure 12:
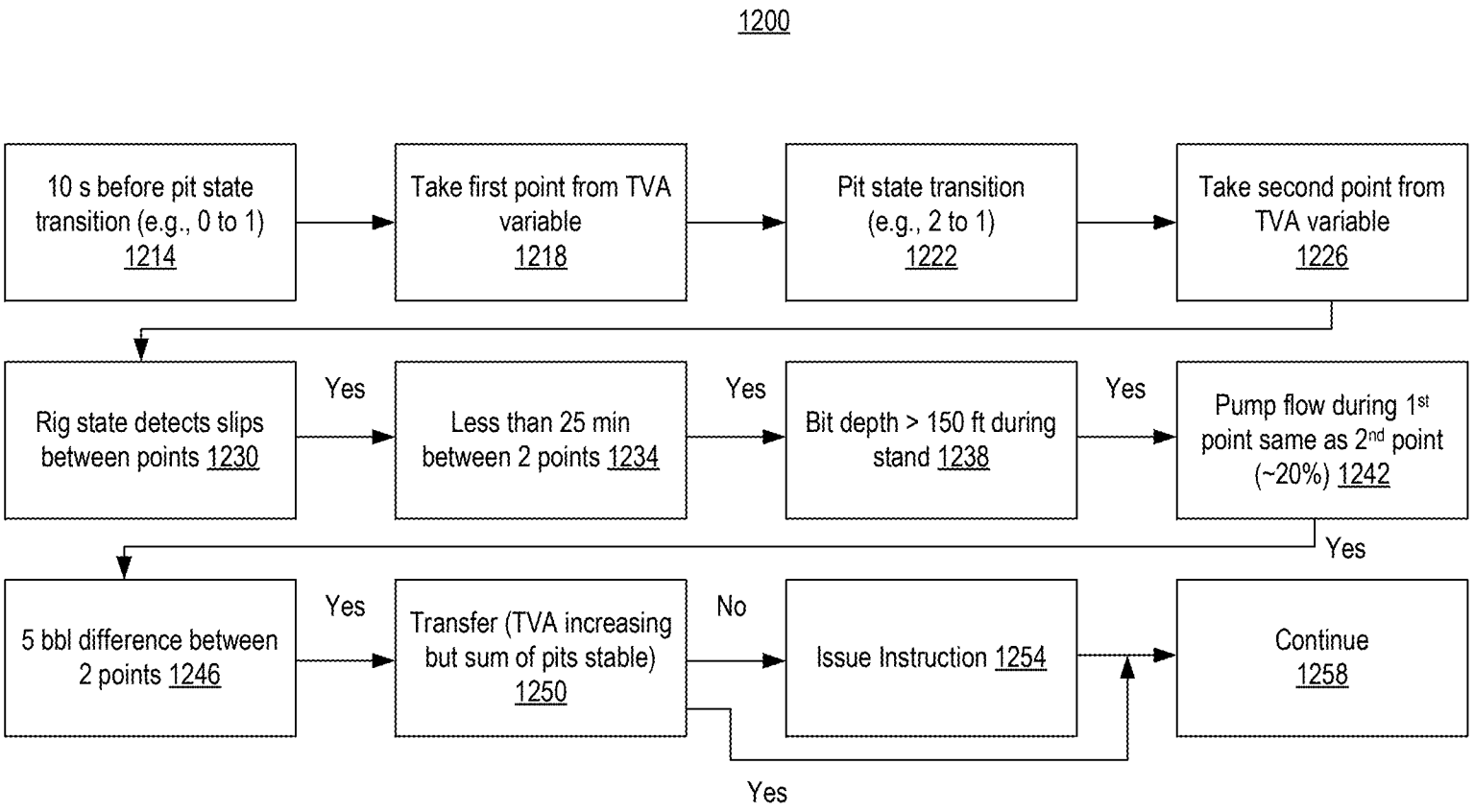
FIG. 12 shows an example of a method.

FIG. 12 shows an example of a method 1200 that may be implemented by a framework. As shown, the method 1200 may include a series of actions, represented by blocks. For example, consider a block 1214 that notes a time window of 10 seconds prior to a pit state transition (e.g., from 0 to 1), a block 1218 that takes a first point from a TVA variable, a block 1222 that notes a pit state transition (e.g., from 2 to 1), a block 1226 that takes a second point from the TVA variable, a block 1230 that makes a decision that utilizes a rig state to decide whether there is a detection of slips between the first point and the second point, a block 1234 that makes a decision as to whether there is less than an certain amount of time between the first point and the second point (e.g., 25 minutes, etc.), a block 1238 that makes a decision as to whether a bit depth is greater than a certain depth during the stand (e.g., greater than 150 feet or other distance sufficiently distant from surface), a block 1242 that decides whether the pump flow rate during the first point is the effectively the same as during the second point (e.g., within approximately 20 percent, etc.), a block 1246 that compares the volume difference between the first point and the second point to a threshold (e.g., 5 bbl), and a block 1250 that decides whether a transfer exists (e.g., TVA increasing but sum of pits stable), where, if the block 1250 decides that a transfer exists, the method 1200 continues per a continuation block 1258 (e.g., for assessing another connection, etc.) and where, if the block 1250 decides that a transfer does not exist (e.g., not occurring), the method 1200 continues to an issuance block 1254 for issuance of an alarm, control instruction, etc.

As an example, in one embodiment, as time passes, various blocks of the method 1200 may be repeated; noting that one or more parameters (e.g., times, volumes, etc.) may be adjusted to comport with a particular drilling fluid system, operations, etc.

In one embodiment, at the time a pit state value transitions from stable to staging down (e.g., from 1 to 0), and a rig state is not yet set to inslips, as a potentially already taken prior (e.g., before) reference point, values for the following variables may be captured for a first or updated "before" reference point (e.g., consider 10 seconds in the past relative to the current time per the block 1214): bit depth, mud flow rate in, active mud tank volume, and total tank volume.

As an example, if a threshold period of time (e.g., more than 25 minutes) has passed since the "before" reference point, the approach may discard the "before" reference point (see, e.g., the block 1234).

In response to the pit state transition from transient to stable (e.g., from 2 to 1), a framework may provide for allowing arbitrary pit state values between transient and stable during a particular interval (e.g., consider an interval of approximately three minutes) and if the rig state has been inslips since the "before" reference point (see, e.g., the block 1230), the framework may take the following actions, labeled A, B and C:

A. Take the following values for the "after" reference point: bit depth, mud flow rate in, active mud tank volume, and total tank volume.

B. Compute the outputs as shown in the table of outputs (above).

C. Trigger an alarm and/or control action, for example, set output of an active pit connection alarm to 1, at the time of the "after" reference point if a set of conditions are met such as, for example, where the following set of conditions are satisfied: Duration between before and after reference points is below a threshold (e.g., 25 minutes) (see, e.g., the block 1234); the bit depth difference is above a set threshold (e.g., 150 ft) (see, e.g., the block 1238); the flow in percentage difference is less than a threshold (e.g. 20%) (see, e.g., the block 1242); the active pit volume difference is greater than a threshold (e.g., 5 bbl) (see, e.g., the block 1246); and the optional input sum of volumes of all pits is specified, for example, the difference of sum of volume of all pits is greater than 0.9*active pit volume difference (i.e., no transfer is detected).

Following completion, the framework may forget (e.g., delete, overwrite, etc.) the "before" and "after" reference points and/or the framework may store such points (e.g., data associated with such points) to a local and/or a remote storage device.

In the example method 1200 of FIG. 12, while the blocks are illustrated in a particular order, the method 1200 may be performed without strict adherence to the order. For example, one or more condition blocks that may provide for decision making may be in an order or orders different than the order shown in FIG. 12 to effectuate such decision making. And, as explained, threshold values are provided as examples and may differ in implementation.

Figure 13:
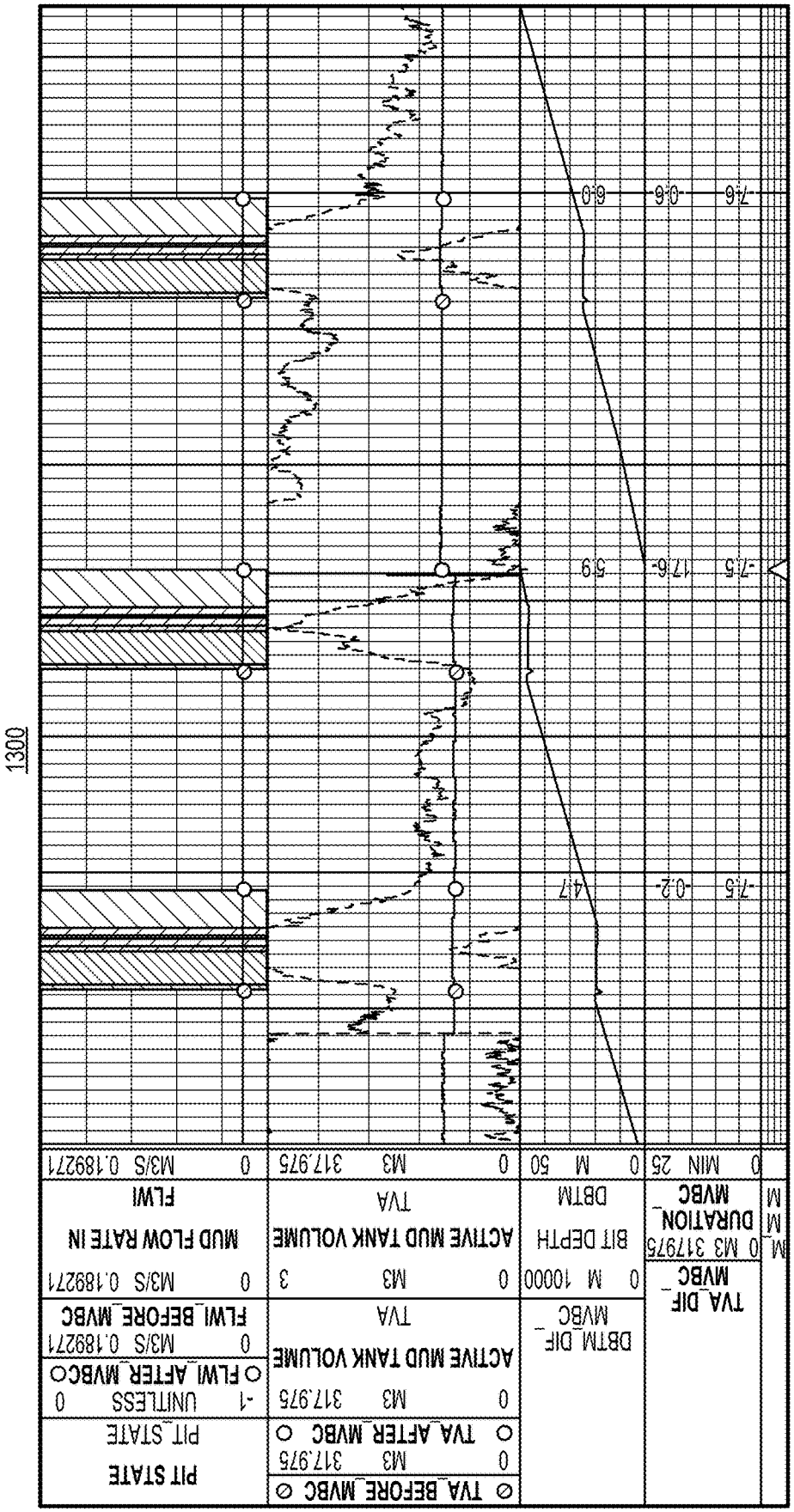
FIG. 13 shows an example of a graphical user interface.

FIG. 13 illustrates an example of a GUI 1300 of one embodiment of the results of a method such as the method 1200 of FIG. 12 for automatic computations for triggering an alarm, a warning, a control action, etc.

In the example of FIG. 13, the GUI 1300 includes various channels that may include a pit state channel, a time channel (e.g., 0 to 25 minutes), a bit depth channel (e.g., 0 to 50 meters, which may provide for a stand-by-stand or block position type of measurement), a TVA channel (e.g., in volume), and a mud flow rate channel (e.g., in volume per unit time). As shown, the pit state indicators may be extended to the mud flow rate channel as an overlay such that an operator may readily compare mud flow rate values to pit states.

In the example of FIG. 13, the GUI 1300 includes an alarm marker that indicates that TVA has increased such that a gain is occurring or has occurred after a series of pit state transitions. In particular, from a stable state to another stable state, there is a marked increase in TVA volume, which is associated with the bit depth channel, which, as explained, may correspond to stand-by-stand operations where a new stand starts at zero and proceeds to approximately 50 meters (e.g., or another length depending on stand length, etc.).

Automatic Alarm of Abnormal Gain in Trip Tank During Stationary Period

As an example, a framework may provide a mechanism that may be used to help reduce risk of one or more types of incidents at a wellsite. In such an example, the framework may provide for monitoring one or more trip tanks during one or more stationary periods. In various instances, flow checks may be part of a well control procedure that may involve a period where all drilling, tripping, and circulating operations are stopped in order to monitor the well. A trip tank may be lined up and changes in its volume are monitored to detect the presence of potential gains. This information may be used to prevent events such as kicks. Disclosed herein is an approach to real-time automation of abnormal gain in trip tanks during stationary periods. In one embodiment, the approach involves identifying stationary periods based on the flow in and bit depth signal. The approach may also involve looking for an absence of circulation and a bit depth stability. The approach then looks for volume increases in the trip tank to detect which ones are lined up. Once the line up detection is completed, the approach may monitor the identified trip tanks to detect abnormal volume increases that merit notification.

The approach may be used to automatically detect abnormal gains in the trip tanks during stationary periods in real time. The automation model may allow the detection of trip tank volume gains during stationary periods. The approach may provide the user with a clear indication of the trip tank volume during stationary periods and raise alarms as needed.

In one embodiment, the approach uses one or more of the following inputs: Absolute time [s]; pit state [unitless]; bit depth [m]; flow out paddle [%]; standpipe pressure [Pa]; trip tank volume 1 [m3]; and trip tank volume 2 [m3].

As an example, an approach may provide the following information:

| Channel | Description | Sample Mnemonic |
|---|---|---|
| Trip tank volume alarm during stationary period | MVBS alarm indicate if a trip tank gain is happening during a stationary period<br>Binary: 0 no alarm; 1 gain alarm | ALARM_MVBS |

In one embodiment, an approach may be used to detect abnormal gains in trip tank lines during one or more stationary periods using logic.

Figure 14:
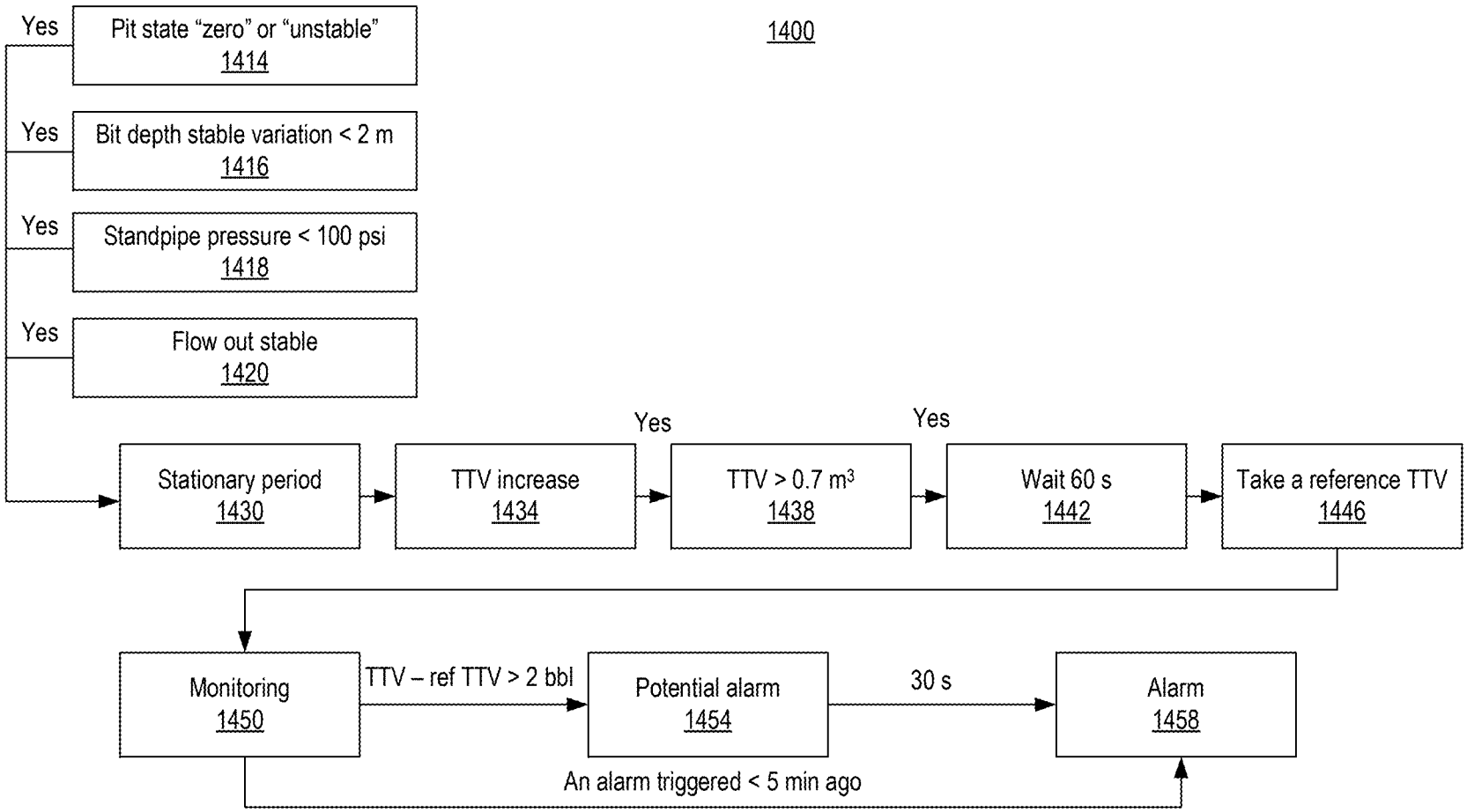
FIG. 14 shows an example of a method.

FIG. 14 shows an example of a method 1400 that includes various blocks that may correspond to various actions. As shown, a series of blocks 1414, 1416, 1418 and 1420 may provide for condition decisions such as, for example, pit state zero or unstable, bit depth stable variation (e.g., less than 2 meters), standpipe pressure below a threshold (e.g., less than 100 psi), and flow out stable (e.g., according to one or more criteria). As shown, the condition decisions may indicate that a stationary period exists per a block 1430. For a stationary period, the method 1400 may decide whether a trip tank volume (TTV) increase exists per a block 1434, decide whether TTV is greater than a threshold (e.g., 0.7 $m^3$) per a block 1438, implement a wait per a block 1442 (e.g., 60 seconds, etc.), and take a reference TTV reading per a block 1446. As shown in the example of FIG. 14, the method 1400 may enter a monitoring block 1450 that may utilize the reference reading of the block 1446. For example, consider determining whether the TTV minus the reference TTV is greater than a threshold volume (e.g., 2 bbl) such that the method 1400 continues to a potential alarm block 1454, which may introduce a wait time, for example, of 30 seconds or other appropriate amount of time, before proceeding to an alarm block 1458, which may call for one or more control actions, issuance of one or more recommended control actions, etc. As indicated in the example of FIG. 14, if an alarm was triggered less than a certain time ago (e.g., 5 minutes), then the monitoring may proceed past the block 1454 and maintain the alarm or reiterate the alarm of the block 1458.

In the example of FIG. 14, the different blocks may be implemented in a different order, where, for example, fewer or more actions may occur than those shown; noting that various limits or thresholds may be appropriately selected or adjusted depending on one or more factors.

In one embodiment, a framework may implement an approach that involves using several conditions to determine a stationary period, for example, as explained with respect to the blocks 1414, 1416, 1418 and 1420. Again, such conditions may include one or more of: pit state value is zero or unstable; bit depth is stable, or substantially stable (e.g., it may determine that the drill string does not move more than 2 meters); the standpipe pressure (SPPA) is less than a threshold amount (e.g., 100 psi); and there is no flowout instability.

As an example, an approach may determine that a trip tank is lined up in response to input values. For example, a trip tank may be declared as lined up if the trip tank volume is more than a threshold amount (e.g., 4.4 barrels) and/or a volume increase is observed during the stationary period.

As an example, an approach may start monitoring a trip tank that is determined to be lined up after a threshold period of time. In one embodiment, a threshold period may be 60 seconds; noting that one or more other time values may be used. As an example, a threshold period may be selected to wait for a trip tank volume to stabilize. In one embodiment, after the threshold period passes, a trip tank volume reference point is taken. In such an example, if the difference between the trip tank volume and the reference point is over a threshold amount, an alarm and/or control action may be triggered. In one embodiment, such a threshold amount may be set to approximately 2 barrels. As an example, an approach may also use a confirmation of a stationary period. For example, consider a confirmation of a 30-second stationary period that may be observed. In addition, a carry forward may be applied to an alarm output. For example, in one embodiment, a 5 minute carry forward may be applied on the alarm output.

Figure 15:
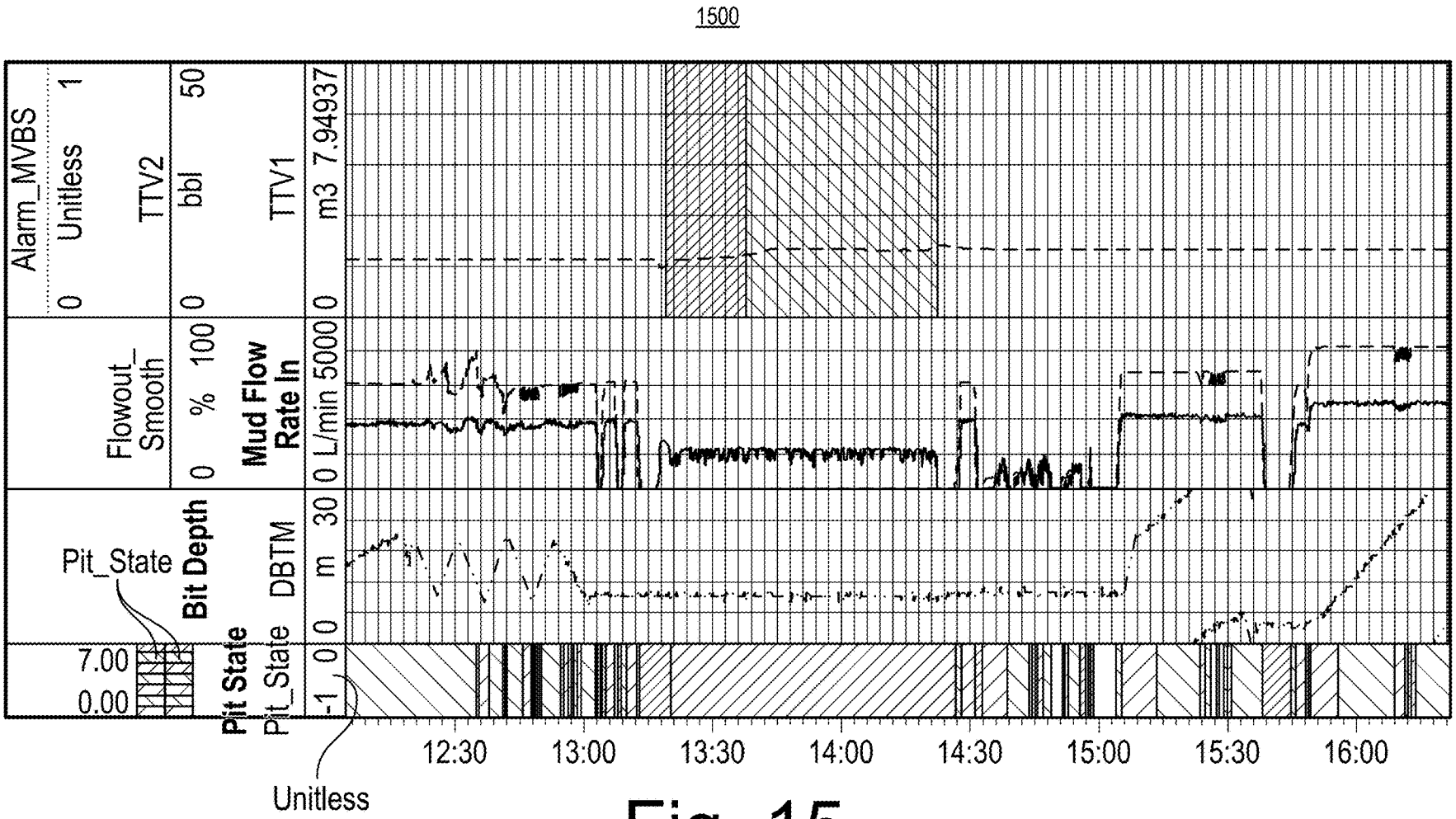
FIG. 15 shows an example of a graphical user interface.

FIG. 15 illustrates an example of a GUI 1500 of example results of a method such as, for example, the method 1400 of FIG. 14. As shown, the GUI 1500 includes various channels such as, for example, a pit state channel, a bit depth channel, a mud flow rate in channel, a flowout channel, an alarm channel and one or more volume channels for one or more trip tanks (e.g., TTV1 and TTV2). In the example of FIG. 15, the bit depth scale is shown as being from 0 meters to 30 meters, which may correspond to stands of approximately 30 meters in length (e.g., three drillpipes of approximately 10 meters each in length joined to form a stand of approximately 30 meters in length).

As explained, a bit depth may be monitored to decide whether it is stable because movement of a bit on a drillstring (e.g., movement of the drillstring) may result in some variation in a reading of a trip tank volume. As to standpipe pressure, if it is above a certain level, there may be one or more inaccuracies of one or more trip tank volume readings. As to flowout, it may be assessed to determine whether it is stable according to one or more criteria. Such conditions may provide for some assurance that one or more trip tank volumes may be adequately measured.

As explained, a framework may utilize data acquired for one or more trip tanks to detect a gain or a loss. As an example, such an approach may provide for detection of a stationary period or stationary state, which may be associated with one or more rig states such as, for example, one or more slips related states. As explained, one or more field operations may be performed with respect to one or more trip tanks of a drilling fluid system where, for example, a framework may provide for monitoring that may result in issuance of one or more alarms and/or control actions.

Figure 16:
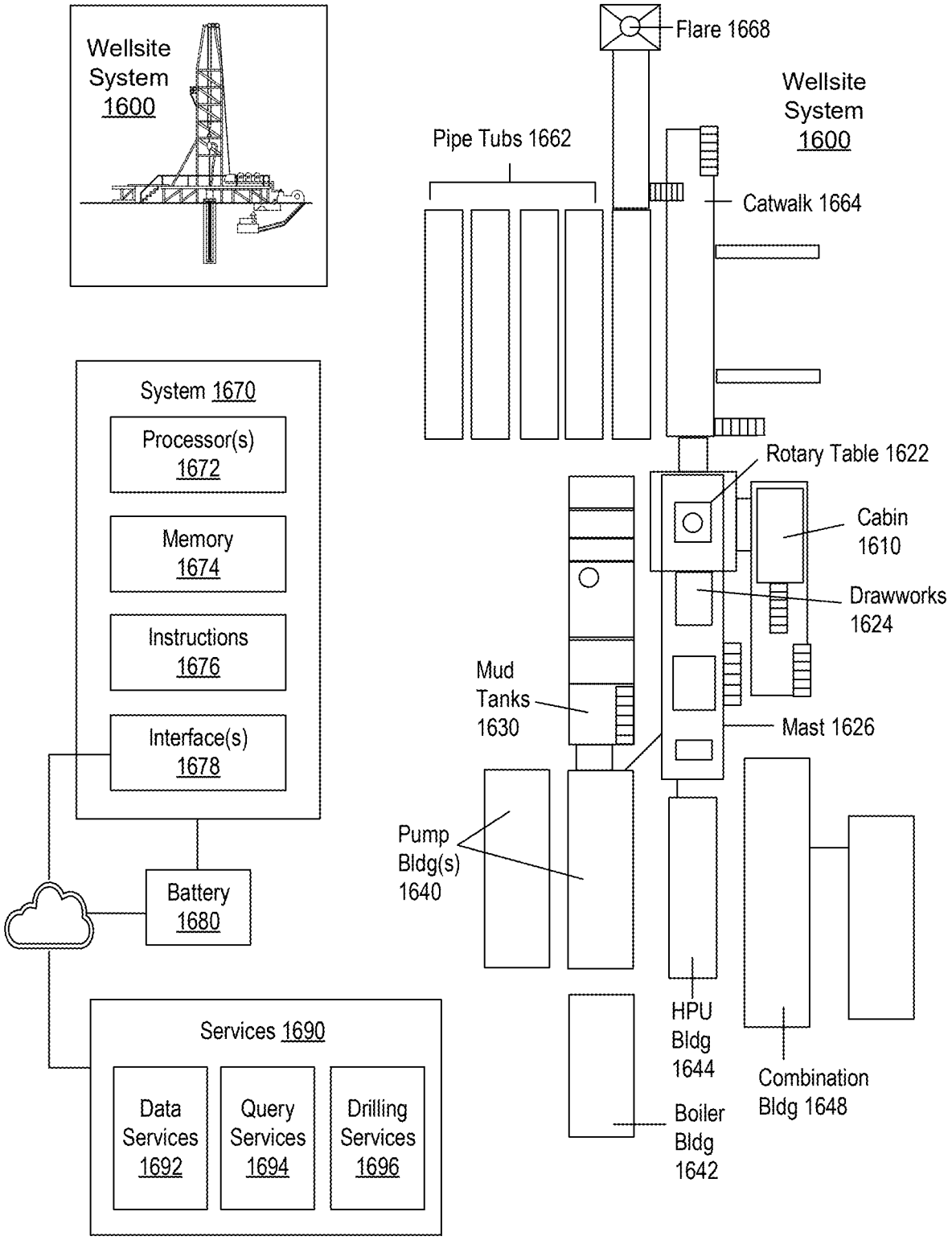
FIG. 16 shows an example of a system.

FIG. 16 shows an example of a wellsite system 1600, specifically, FIG. 16 shows the wellsite system 1600 in an approximate side view and an approximate plan view along with a block diagram of a system 1670.

In the example of FIG. 16, the wellsite system 1600 may include a cabin 1610, a rotary table 1622, drawworks 1624, a mast 1626 (e.g., optionally carrying a top drive, etc.), mud tanks 1630 (e.g., with one or more pumps, one or more shakers, etc.), one or more pump buildings 1640, a boiler building 1642, an HPU building 1644 (e.g., with a rig fuel tank, etc.), a combination building 1648 (e.g., with one or more generators, etc.), pipe tubs 1662, a catwalk 1664, a flare 1668, etc. Such equipment may include one or more associated functions and/or one or more associated operational risks, which may be risks as to time, resources, and/or humans.

As shown in the example of FIG. 16, the wellsite system 1600 may include a system 1670 that includes one or more processors 1672, memory 1674 operatively coupled to at least one of the one or more processors 1672, instructions 1676 that may be, for example, stored in the memory 1674, and one or more interfaces 1678. As an example, the system 1670 may include one or more processor-readable media that include processor-executable instructions executable by at least one of the one or more processors 1672 to cause the system 1670 to control one or more aspects of the wellsite system 1600. In such an example, the memory 1674 may be or include the one or more processor-readable media where the processor-executable instructions may be or include instructions. As an example, a processor-readable medium may be a computer-readable storage medium that is not a signal and that is not a carrier wave.

FIG. 16 also shows a battery 1680 that may be operatively coupled to the system 1670, for example, to power the system 1670. As an example, the battery 1680 may be a back-up battery that operates when another power supply is unavailable for powering the system 1670. As an example, the battery 1680 may be operatively coupled to a network, which may be a cloud network. As an example, the battery 1680 may include smart battery circuitry and may be operatively coupled to one or more pieces of equipment via a SMBus or other type of bus.

In the example of FIG. 16, services 1690 are shown as being available, for example, via a cloud platform. Such services may include data services 1692, query services 1694 and drilling services 1696. As an example, the services 1690 may be part of a system, a framework, etc. As an example, the services 1690 may include one or more services for directional drilling, which may include, for example, a steering tendency service or services (e.g., consider a computational framework that may provide for one or more services that utilize survey information to estimate one or more steering response parameters, etc.). As an example, the services 1690 may include one or more services associated with a drilling fluid system, which may include, for example, the mud tanks 1630 and pumps of the pump buildings 1640. As explained, a framework may provide for detection of one or more of a gain, a loss, an equipment issue, a procedure issue, etc. As explained, a framework may provide for issuance of one or more alarms, control actions, etc., as may be associated with one or more types of formation interactions (e.g., flow of formation fluid into a wellbore, flow of drilling fluid into a formation, etc.). As an example, the system 1670 may be utilized for detection of one or more issues, which may, for example, be utilized to control one or more field operations.

Figure 17:
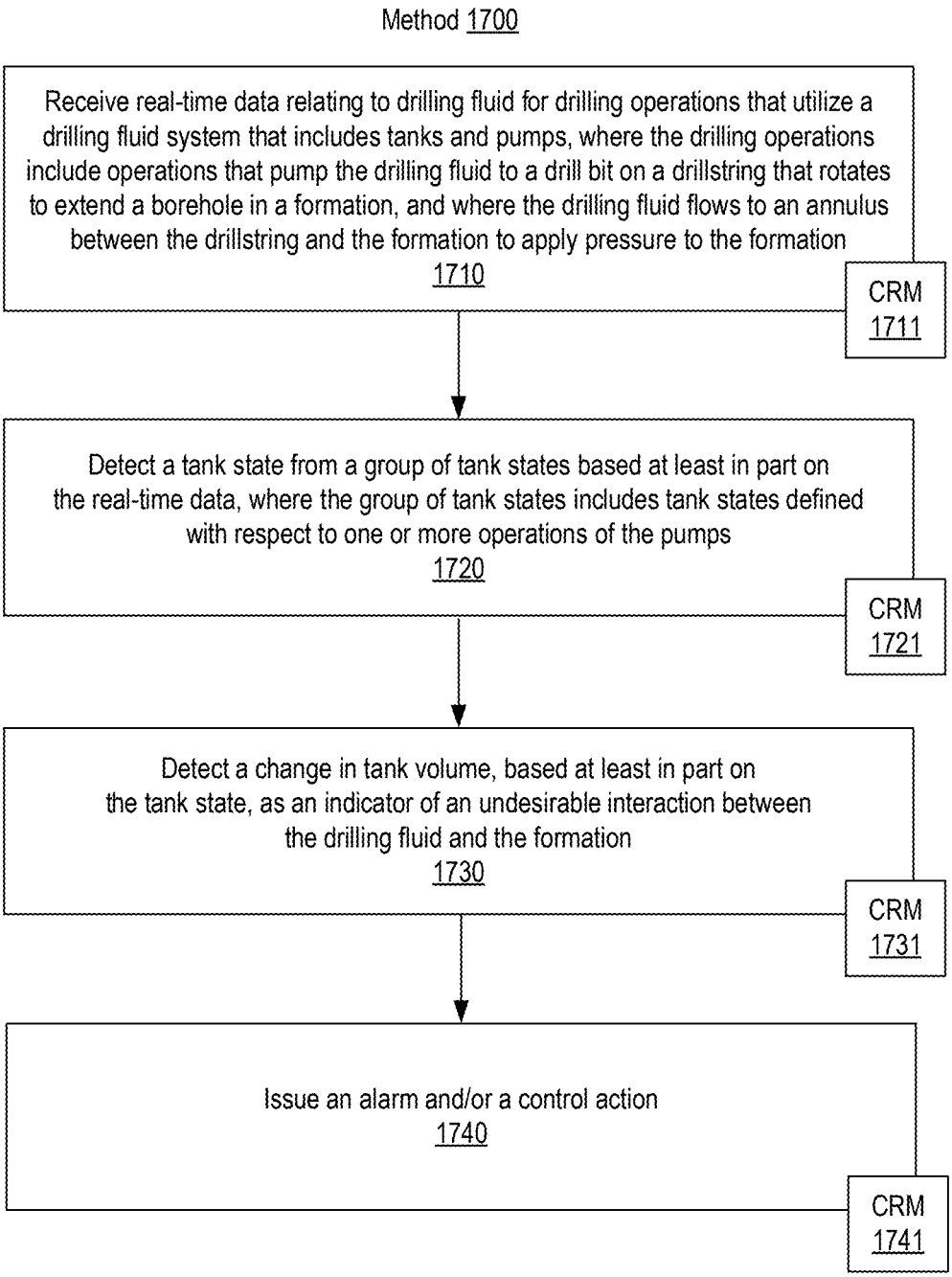
FIG. 17 shows an example of a method.

FIG. 17 shows an example of a method 1700 that may include a reception block 1710 for receiving real-time data relating to drilling fluid for drilling operations that utilize a drilling fluid system that includes tanks and pumps, where the drilling operations include operations that pump the drilling fluid to a drill bit on a drillstring that rotates to extend a borehole in a formation, and where the drilling fluid flows to an annulus between the drillstring and the formation to apply pressure to the formation; a detection block 1720 for detecting a tank state from a group of tank states based at least in part on the real-time data, where the group of tank states includes tank states defined with respect to one or more operations of the pumps; and a detection block 1730 for detecting a change in tank volume, based at least in part on the tank state, as an indicator of an undesirable interaction between the drilling fluid and the formation. As shown, the method 1700 may include an issuance block 1740 for issuing an alarm and/or a control action. For example, consider an alarm for a kick, a control action to address a kick, an alarm for formation damage, a control action to address formation damage, etc.

As shown in FIG. 17, the method 1700 may be implemented via one or more computer-readable media (CRM) per blocks 1711, 1721, 1731 and 1741, which may, for example, be implemented using a system such as a computing system (see, e.g., the example system 300 of FIG. 3, the example system 1670 of FIG. 16, etc.). Such blocks may include processor-executable instructions.

As explained, various systems, methods, etc., may implement one or more ML models. As to types of ML models, consider one or more of a support vector machine (SVM) model, a k-nearest neighbors (KNN) model, an ensemble classifier model, a neural network (NN) model, incremental learning, Q-learning, etc. As an example, a machine learning model may be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average one-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a system may utilize one or more recurrent neural networks (RNNs). One type of RNN is referred to as long short-term memory (LSTM), which may be a unit or component (e.g., of one or more units) that may be in a layer or layers. A LSTM component may be a type of artificial neural network (ANN) designed to recognize patterns in sequences of data, such as time series data. When provided with time series data, LSTMs take time and sequence into account such that an LSTM may include a temporal dimension. For example, consider utilization of one or more RNNs for processing temporal data from one or more sources, optionally in combination with spatial data. Such an approach may recognize temporal patterns, which may be utilized for making predictions (e.g., as to a pattern or patterns for future times, etc.).

As an example, the TENSORFLOW framework (Google LLC, Mountain View, California) may be implemented, which is an open-source software library for dataflow programming that includes a symbolic math library, which may be implemented for machine learning applications that may include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As mentioned, a framework such as the PYTORCH framework may be utilized.

As an example, a training method may include various actions that may operate on a dataset to train a ML model. As an example, a dataset may be split into training data and test data where test data may provide for evaluation. A method may include cross-validation of parameters and best parameters, which may be provided for model training.

The TENSORFLOW framework may run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system-based platforms.

TENSORFLOW computations may be expressed as stateful dataflow graphs; noting that the name TENSORFLOW derives from the operations that such neural networks perform on multidimensional data arrays. Such arrays may be referred to as "tensors".

As an example, one or more detection techniques may implement one or more ML models. In such an example, the one or more detection techniques may provide for tank state detection and/or change in tank volume detection.

As an example, a method may include receiving real-time data relating to drilling fluid for drilling operations that utilize a drilling fluid system that includes tanks and pumps, where the drilling operations include operations that pump the drilling fluid to a drill bit on a drillstring that rotates to extend a borchole in a formation, and where the drilling fluid flows to an annulus between the drillstring and the formation to apply pressure to the formation; detecting a tank state from a group of tank states based at least in part on the real-time data, where the group of tank states include tank states defined with respect to one or more operations of the pumps; and detecting a change in tank volume, based at least in part on the tank state, as an indicator of an undesirable interaction between the drilling fluid and the formation.

As an example, an undesirable interaction between drilling fluid and a formation may include flow of formation fluid from the formation into the borchole. In such an example, the change in tank volume may be an increase in tank volume. As an example, a method may include issuing an instruction to address a kick. For example, consider the instruction being to address the kick to reduce risk of a blowout. As an example, an instruction may instruct a drilling fluid system to increase pressure applied to a formation (e.g., consider an adjustment to density of drilling fluid, etc.).

As an example, an undesirable interaction between drilling fluid and a formation may include flow of a portion of the drilling fluid from a borchole into the formation. In such an example, a change in tank volume may be a decrease in tank volume. As an example, a method may include issuing an instruction to address a risk of formation damage. For example, consider an instruction that instructs a drilling fluid system to decrease pressure applied to the formation.

As an example, one or more operations of pumps may include a pumping down operation indicative of an expected increase in tank volume of one or more tanks. As an example, one or more operations of pumps may include a pumping up operation indicative of an expected decrease in tank volume of one or more tanks.

As an example, a method may include detecting a change in tank volume by selecting a computational technique based at least in part on the tank state. For example, different tank states (e.g., pit states) may be associated with different computational techniques. As an example, a computational technique may account for pump operation.

As an example, tanks of a drilling fluid system may include trip tanks and, for example, a method may include detecting a change in tank volume by detecting a change in volume of one or more of the trip tanks. In such an example, the detecting may include detecting a stationary period based on one or more conditions prior to the detecting a change in volume of one or more of the trip tanks.

As an example, real-time data may include bit depth data and tank volume data. For example, various GUIs illustrate channels of data that may be acquired to perform one or more detection methods.

As an example, a method may include detecting a change in tank volume as an indicator of an issue with the drilling fluid system. In such an example, the issue may include one or more of an equipment issue and an operating procedure issue.

As an example, a system may include one or more processors; memory accessible to at least one of the one or more processors; processor-executable instructions stored in the memory and executable to instruct the system to: receive real-time data relating to drilling fluid for drilling operations that utilize a drilling fluid system that includes tanks and pumps, where the drilling operations include operations that pump the drilling fluid to a drill bit on a drillstring that rotates to extend a borehole in a formation, and where the drilling fluid flows to an annulus between the drillstring and the formation to apply pressure to the formation; detect a tank state from a group of tank states based at least in part on the real-time data, where the group of tank states includes tank states defined with respect to one or more operations of the pumps; and detect a change in tank volume, based at least in part on the tank state, as an indicator of an undesirable interaction between the drilling fluid and the formation.

As an example, one or more non-transitory computer-readable storage media may include processor-executable instructions to instruct a computing system to: receive real-time data relating to drilling fluid for drilling operations that utilize a drilling fluid system that includes tanks and pumps, where the drilling operations include operations that pump the drilling fluid to a drill bit on a drillstring that rotates to extend a borehole in a formation, and where the drilling fluid flows to an annulus between the drillstring and the formation to apply pressure to the formation; detect a tank state from a group of tank states based at least in part on the real-time data, where the group of tank states includes tank states defined with respect to one or more operations of the pumps; and detect a change in tank volume, based at least in part on the tank state, as an indicator of an undesirable interaction between the drilling fluid and the formation.

As an example, a computer program product that may include computer-executable instructions to instruct a computing system to perform one or more methods such as one or more of the methods described herein (e.g., in part, in whole and/or in various combinations).

Conclusion

The embodiments disclosed in this disclosure are to help explain the concepts described herein. This description is not exhaustive and does not limit the claims to the precise embodiments disclosed. Modifications and variations from the exact embodiments in this disclosure may still be within the scope of the claims.

Likewise, the steps described need not be performed in the same sequence discussed or with the same degree of separation. Various steps may be omitted, repeated, combined, or divided, as appropriate. Accordingly, the present disclosure is not limited to the above-described embodiments, but instead is defined by the appended claims in light of their full scope of equivalents. In the above description and in the below claims, unless specified otherwise, the term "execute" and its variants are to be interpreted as pertaining to any operation of program code or instructions on a device, whether compiled, interpreted, or run using other techniques.

The claims that follow do not invoke section 112(f) unless the phrase "means for" is expressly used together with an associated function.

What is claimed is:

1. A method, comprising:

receiving real-time data relating to drilling fluid for drilling operations in a formation that utilize a drilling fluid system comprising tanks and pumps, the drilling operations comprising operations that pump the drilling fluid to a drill bit, the drill bit generating waste, the drilling fluid flowing to remove the waste generated by the drill bit;

detecting a tank state from a discrete predefined list of tank states based at least in part on the real-time data, the list of tank states comprising tank states defined with respect to one or more operations of the pumps, each tank state being based on a flow rate of the drilling fluid with respect to at least one of the tanks, the list of tank states identifying a status of the flow rate of the drilling fluid with respect to the at least one of the tanks;

detecting a change in tank volume, based at least in part on the tank state, as an indicator of an undesirable interaction between the drilling fluid and the formation; and in response to the change in the tank volume being detected as the indicator of the undesirable interaction, automatically issuing a control signal for well control to change the pumping of the drilling fluid to the drill bit to address the undesirable interaction to reduce risk of one or more catastrophic events from being caused by the undesirable interaction.

2. The method of claim 1, wherein the undesirable interaction between the drilling fluid and the formation comprises flow of formation fluid from the formation.

3. The method of claim 2, wherein the change in tank volume is an increase in tank volume.

4. The method of claim 2, further comprising issuing an instruction to address a kick.

5. The method of claim 4, wherein the instruction to address the kick reduces risk of a blowout.

6. The method of claim 4, wherein the instruction instructs the drilling fluid system to increase pressure applied to the formation.

7. The method of claim 1, wherein the undesirable interaction between the drilling fluid and the formation comprises flow of a portion of the drilling fluid into the formation.

8. The method of claim 7, wherein the change in tank volume is a decrease in tank volume.

9. The method of claim 7, further comprising issuing an instruction to address a risk of formation damage.

10. The method of claim 9, wherein the instruction instructs the drilling fluid system to decrease pressure applied to the formation.

11. The method of claim 1, wherein one of the one or more operations of the pumps comprises a pumping down operation indicative of an expected increase in tank volume of one or more of the tanks.

12. The method of claim 1, wherein one of the one or more operations of the pumps comprises a pumping up operation indicative of an expected decrease in tank volume of one or more of the tanks.

13. The method of claim 1, wherein the detecting the change in the tank volume comprises selecting a computational technique based at least in part on the tank state.

14. The method of claim 1, wherein:

the tanks comprise trip tanks; and the detecting the change in the tank volume comprises detecting a change in volume of one or more of the trip tanks.

15. The method of claim 14, wherein the detecting the change in the tank volume further comprises detecting a stationary period based on one or more conditions prior to the detecting the change in the volume of the one or more of the trip tanks.

16. The method of claim 1, wherein the real-time data comprise bit depth data and tank volume data.

17. The method of claim 1, comprising detecting an additional change in the tank volume as an indicator of an issue with the drilling fluid system.

18. The method of claim 17, wherein the issue comprises one or more of an equipment issue and an operating procedure issue.

19. A system, comprising:

one or more processors;

memory accessible to at least one of the one or more processors; and processor-executable instructions stored in the memory and executable to instruct the system to:

receive real-time data relating to drilling fluid for drilling operations in a formation that utilize a drilling fluid system comprising tanks and pumps, the drilling operations comprising operations that pump the drilling fluid to a drill bit, the drill bit generating waste, the drilling fluid flowing to remove the waste generated by the drill bit;

detect a tank state from a discrete predefined list of tank states based at least in part on the real-time data, the list of tank states comprising tank states defined with respect to one or more operations of the pumps, each tank state being based on a flow rate of the drilling fluid with respect to at least one of the tanks, the list of tank states identifying a status of the flow rate of the drilling fluid with respect to the at least one of the tanks;

detect a change in tank volume, based at least in part on the tank state, as an indicator of an undesirable interaction between the drilling fluid and the formation; and in response to the change in the tank volume being detected as the indicator of the undesirable interaction, automatically issue a control signal for well control to change the pumping of the drilling fluid to the drill bit to address the undesirable interaction to reduce risk of one or more catastrophic events from being caused by the undesirable interaction.

20. One or more non-transitory computer-readable storage media comprising processor-executable instructions to instruct a computing system to:

receive real-time data relating to drilling fluid for drilling operations in a formation that utilize a drilling fluid system comprising tanks and pumps, the drilling operations comprising operations that pump the drilling fluid to a drill bit, the drill bit generating waste, the drilling fluid flowing to remove the waste generated by the drill bit;

detect a tank state from a discrete predefined list of tank states based at least in part on the real-time data, the list of tank states comprising tank states defined with respect to one or more operations of the pumps, each tank state being based on a flow rate of the drilling fluid with respect to at least one of the tanks, the list of tank states identifying a status of the flow rate of the drilling fluid with respect to the at least one of the tanks;

detect a change in tank volume, based at least in part on the tank state, as an indicator of an undesirable interaction between the drilling fluid and the formation; and in response to the change in the tank volume being detected as the indicator of the undesirable interaction, automatically issue a control signal for well control to change the pumping of the drilling fluid to the drill bit to address the undesirable interaction to reduce risk of one or more catastrophic events from being caused by the undesirable interaction.

* * * * *